US010729958B1

(12) United States Patent
Coffey et al.

(10) Patent No.: US 10,729,958 B1
(45) Date of Patent: Aug. 4, 2020

(54) FLAT AND FOLDABLE SHEET GAME BOARD

(71) Applicant: Park Bench Holdings LLC, Las Vegas, NV (US)

(72) Inventors: Robert A. Coffey, Las Vegas, NV (US); Bernard S. Coffey, Farmington, NM (US)

(73) Assignee: Park Bench Holdings LLC, Las Vegas, NV (US)

( * ) Notice: Subject to any disclaimer, the term of this patent is extended or adjusted under 35 U.S.C. 154(b) by 0 days.

(21) Appl. No.: 16/670,859

(22) Filed: Oct. 31, 2019

(51) Int. Cl.
*G09F 1/00* (2006.01)
*A63B 63/00* (2006.01)
*A63F 7/06* (2006.01)

(52) U.S. Cl.
CPC ..... *A63B 63/004* (2013.01); *A63F 7/0616* (2013.01); *A63F 7/0632* (2013.01); *A63B 2210/50* (2013.01)

(58) Field of Classification Search
CPC . A63B 63/004; A63B 2210/50; A63F 7/0632; A63F 7/0616
USPC ..... 273/108, 109, 110, 111, 108.1, 108.4, 273/108.41, 317.3, 317.5, 247, 245
See application file for complete search history.

(56) References Cited

U.S. PATENT DOCUMENTS 2,074,420 A 3/1937 Frederic
D123,125 S * 10/1940 Holstein ..... D9/415
4,460,146 A 7/1984 Raggiotti
5,010,669 A * 4/1991 Moran ..... G09F 1/08 229/92.8
5,259,133 A * 11/1993 Burtch ..... B42D 15/045 40/124.08
5,607,135 A 3/1997 Yamada
5,611,161 A * 3/1997 Murphy ..... G09F 1/08 40/124.08
7,527,235 B2 5/2009 Hummel
7,775,525 B2 8/2010 Stayer et al.
7,861,995 B2 * 1/2011 Liou ..... F16M 11/105 248/454
8,726,548 B2 * 5/2014 Larson ..... A63F 7/0628 40/124.08
D720,010 S 12/2014 Waldron
9,751,007 B2 * 9/2017 Mayer ..... A63F 13/22
9,918,545 B2 * 3/2018 van Hooft ..... A47B 23/043
2012/0074644 A1 3/2012 O'Reilly
2013/0270413 A1 * 10/2013 Wilber ..... F16M 11/00 248/558

* cited by examiner

*Primary Examiner* — Vishu K Mendiratta

(74) *Attorney, Agent, or Firm* — Thomas W. Galvani, P.C.; Thomas W. Galvani

(57) ABSTRACT

A device including a base sheet, a top sheet fixed to the base sheet, and a profile cut into the top sheet delineating a foldable shape from a flat shape in the top sheet, wherein the foldable shape moves between a lowered position and a raised position. The flat shape has a forwardly-directed edge, projecting above the base sheet to define a stop formed by both the base sheet and the top sheet, and against which a rearwardly-directed edge of the foldable shape rests when the foldable shape is in the raised position.

20 Claims, 20 Drawing Sheets

FLAT AND FOLDABLE SHEET GAME BOARD

FIELD OF THE INVENTION

The present invention relates generally to entertainment, and more particularly to board game toys.

BACKGROUND OF THE INVENTION

Boredom is waiting to strike at any time, but it seems to particularly enjoy appearing at school, during meetings, lectures, and other dull and dreary experiences. For decades, children have fashioned distractions from paper, pencil, spit, and straw. But such toys are for kids. A more refined, more sophisticated boredom eliminator has been needed for some time.

SUMMARY OF THE INVENTION

A device including a base sheet, a top sheet fixed to the base sheet, and a profile cut into the top sheet delineating a foldable shape from a flat shape in the top sheet, wherein the foldable shape moves between a lowered position and a raised position. The flat shape has a forwardly-directed edge, projecting above the base sheet to define a stop formed by both the base sheet and the top sheet, and against which a rearwardly-directed edge of the foldable shape rests when the foldable shape is in the raised position.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1A:
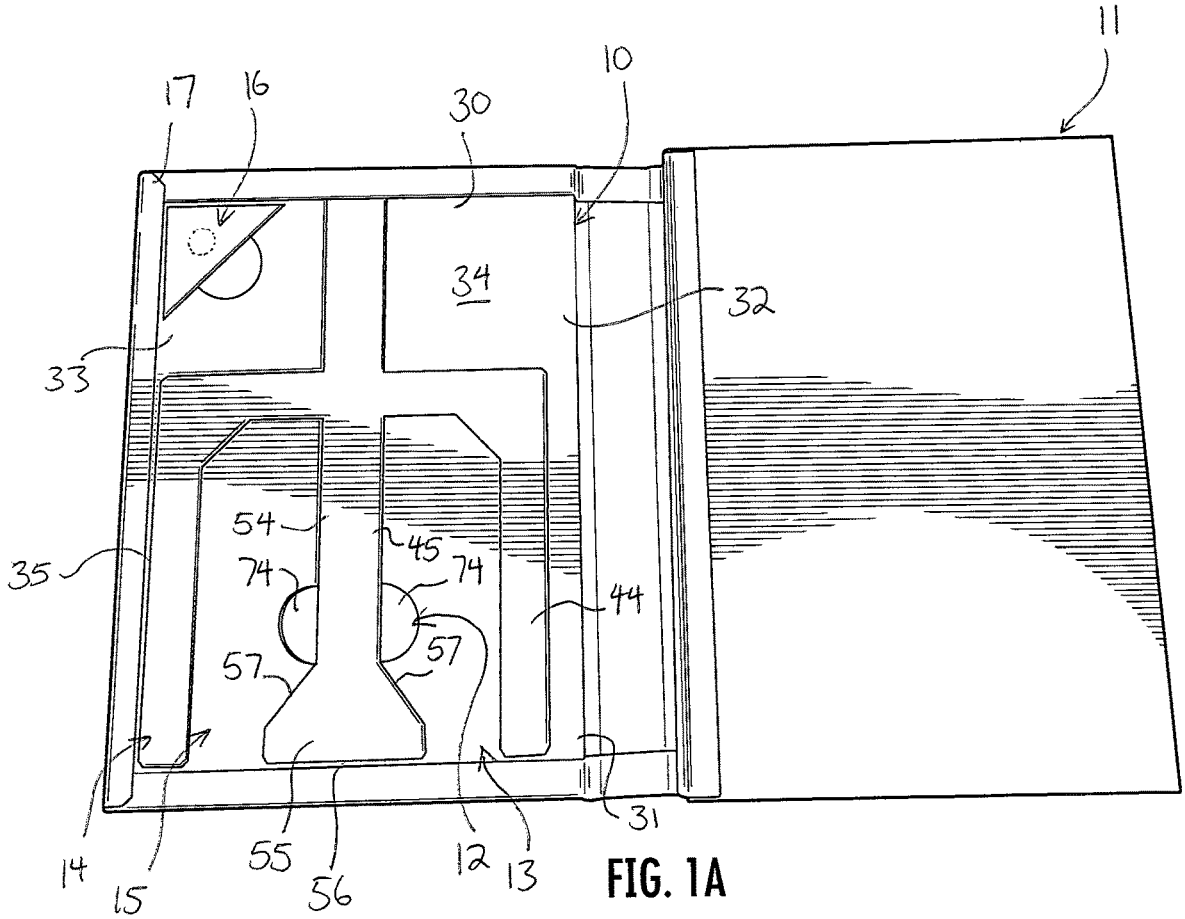
FIG. 1A is a top perspective view of a game board with a foldable shape in a lowered position.

Reference now is made to the drawings, in which the same reference characters are used throughout the different figures to designate the same elements. FIGS. 1A-1D illustrate an embodiment of a game board 10 for playing a football-themed game. The board 10 is incorporated into a notebook 11 so that the board 10 is available to the owner at any time the owner becomes bored or desires a distraction; the owner can open the notebook 11, set up the board 10, and play on his own or with other people. By unfolding the board 10, the owner has a set of football uprights and a play ball that can be thrown or flicked through the uprights, and in seconds the board 10 can be folded back and the notebook 11 carried with the person. The board 10 is durable and constructed to sustain repeated folding and unfolding, so that it lasts for as long as the notebook 11 itself is useful.

The game board 10 includes a base sheet 12 and a top sheet 13 superposed on the base sheet 12 and fixed thereto. The top sheet 13 includes a foldable shape 14 that moves into and out of a flat shape 15, between a lowered position (as shown in FIG. 1A) and a raised position (as shown in FIGS. 1C and 1D) in which the foldable shape 14 forms a goal, so that a game piece 16 can be passed through the goal.

In the embodiment shown in FIGS. 1A-1D, the base sheet 12 is a rigid sheet of material forming the cover of the notebook 11. In some embodiments, the base sheet 12 is a separate piece of material, or is a separate piece of material bonded to otherwise fixed to the cover of a notebook 11, or may be a separate piece of material free of the notebook 11 cover entirely but available to be inserted into the notebook 11. In these drawings, however, the base sheet 12, and indeed, the board 10, is shown as part of the notebook 11. Indeed, the notebook has a cover 17 constructed from fabric, woven cloth, leather, bicast leather, coated paper, or the like, which is wrapped over and glued to the board 10 to permanently secure it as part of the notebook 11.

Figure 1B:
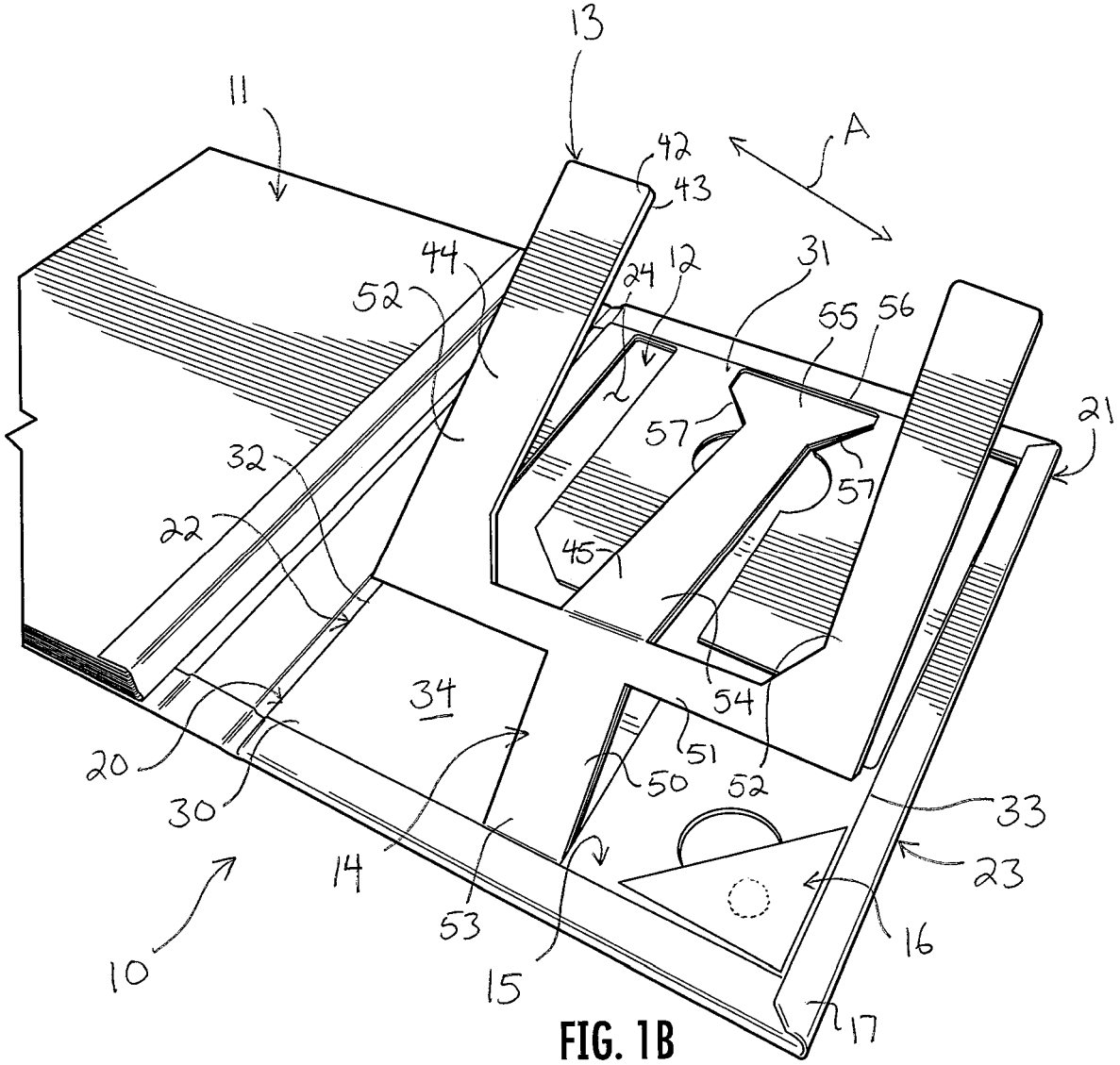
FIGS. 1B-1D are top perspective views of the game board of FIG. 1A, with the foldable shape being raised to a raised position.
Figure 1C:
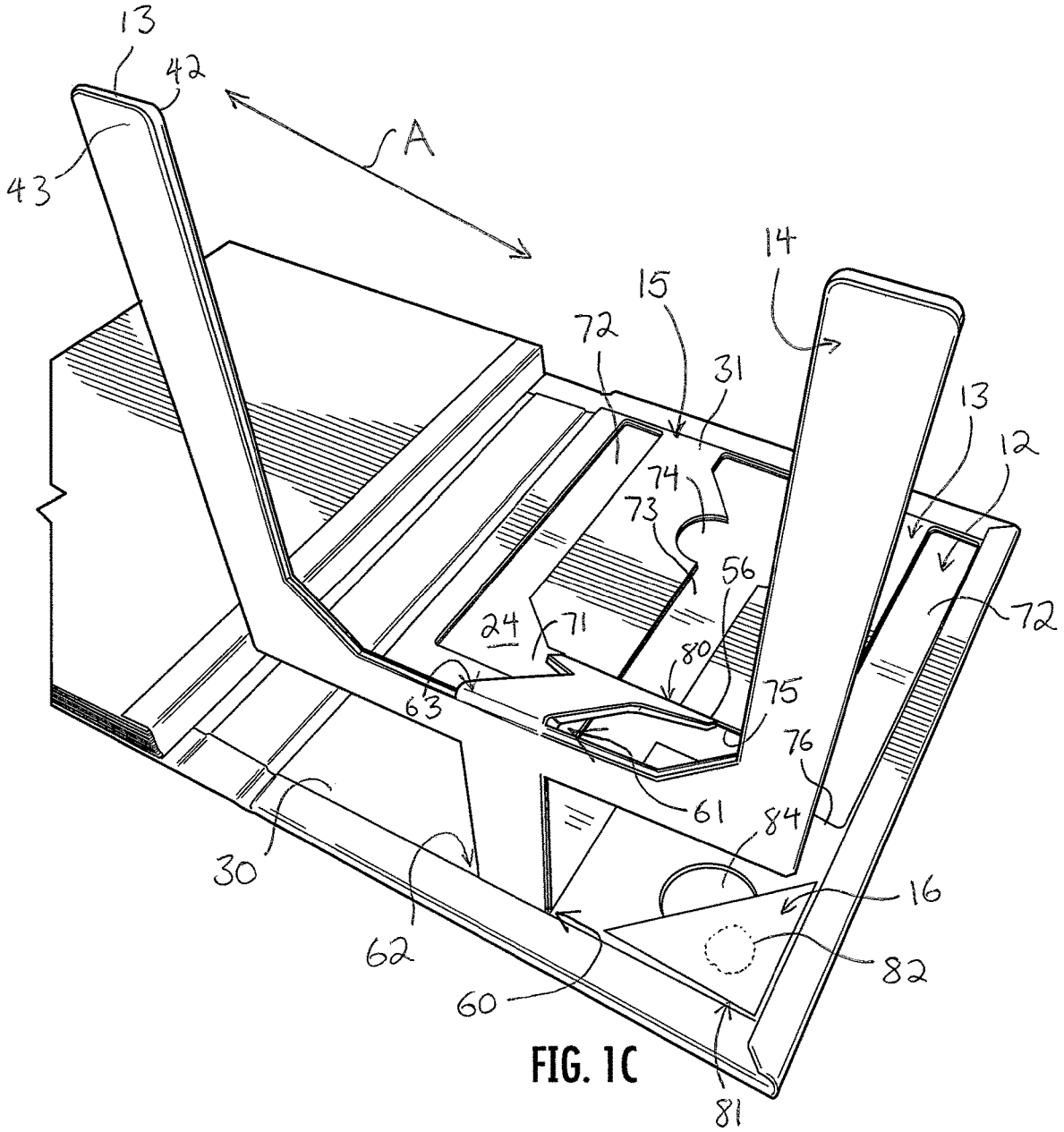
Figure 1D:
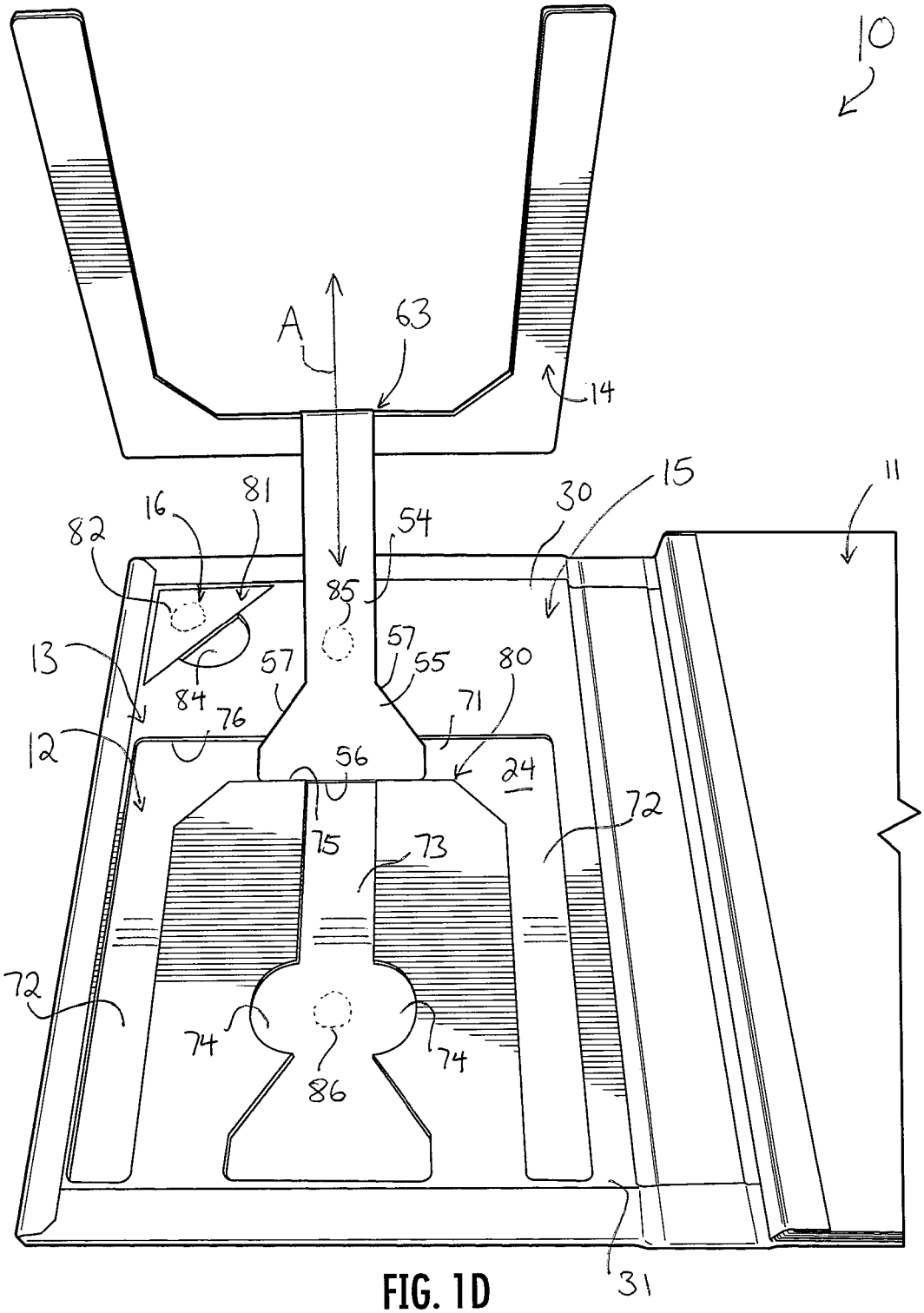

In FIG. 1B, the base sheet 12 is mostly hidden from view under the top sheet 13, but it can be seen in places where the foldable shape 14 is lifted up. As such, names and reference characters for various structural elements and features of the base sheet 12 will be identified but may not be visible; nevertheless, one having ordinary skill in the art should be able to readily understand them, given they are basic parts. For instance, the base sheet 12 has a front 20, a back 21, and opposed sides 22 and 23. The base sheet 12 has a top, directed upwardly away from the page, and an opposed bottom, directed downwardly into the page. The base sheet 12 is rectangular but need not be so limited; in notebooks 11 of different sizes and shapes, the base sheet 12 has different proportions than those shown in the drawings, and where the board 10 is separate from the notebook 11, the base sheet 12 has any suitable size and shape. The base sheet 12, however, is preferably rigid, strong, and durable, constructed from a material or combination of materials such as thick cardstock, plastic, or even metal. The base sheet 12 additionally has a top surface 24 which is exposed in areas in which the foldable shape 14 is lifted up. The top surface 24 is flat, smooth, and continuous between the front 20, back 21, and sides 22 and 23.

The top sheet 13 is carried against this top surface 24. The top sheet 13 is also constructed from a material or combination of materials such as thick cardstock, plastic, or even metal, having rigid, strong, and durable material characteristics. However, the top sheet 13 is cut so that portions of it can be separated from, lifted off of, and arranged with respect to the base sheet 12. In this way, the top sheet 13 forms the goal with which the user plays.

Referring still to FIGS. 1A-1D but primarily to FIGS. 1A and 1B, the top sheet 13 has a front 30, a back 31, opposed sides 32 and 33, a bottom directed toward the top surface 24 of the base sheet 12, and an opposed top 34. The front 30 and back 31 are preferably parallel to each other, and each perpendicular to each of the sides 32 and 33, which in turn are preferably parallel to each other. The top sheet 13 is thin between the bottom and top 34, having a thickness of approximately a few millimeters.

A profile 35 is cut into the top sheet 13. The profile is a cut passing entirely through the top sheet 13 from the top 34 to the bottom. It is continuous around the top sheet 13 so as to define a contour or shape in the top sheet 13. The contour is one of, roughly, a goal and a support for the goal. Indeed, the profile 35 delineates and severs the foldable shape 14 from the flat shape 15. While the foldable shape 14 is lifted and arranged to define the goal as an upstanding object with the support behind it, the flat shape 15 remains flat, in contact with the base sheet 12. The profile 35 is the boundary therebetween, allowing the foldable shape 14 to be entirely separated from and thus lifted above the flat shape 15. Removal of the foldable shape 14, however, is limited by flexible sheets 42 and 43 which are adhered to the top 34 and bottom of the top sheet 13, over both the foldable shape 14 and the flat shape 15. The profile 35 cuts through the flexible sheets 42 and 43 in a corresponding contour to that through the top sheet 13. The flexible sheets 42 and 43 are preferably a fabric, woven cloth, or the like, allowing the foldable shape 14 to move and flex with respect to the flat shape 15; the flexible sheets 42 and 43 are discussed in more detail later.

In the embodiment shown in FIGS. 1A-1D, the foldable shape 14 includes a forward goal 44 and a rearward support 45, where the forward goal 44 is shaped like a football goal or goalposts. A football goal includes a vertical post, a horizontal crossbar, and two vertical uprights spaced apart from each other on the crossbar. Similarly, the goal 44 includes a vertical base 50 at the front of the foldable shape 14, a horizontal crossmember 51, and two vertical uprights 52 at the back of the foldable shape 14, all of which are thin and flat, like the rest of the top sheet 13.

The base 50 has a bottom 53 proximate to the front 30 of the top sheet 13. The bottom 53—and the base 50—are disposed intermediate with respect to the opposed sides 32 and 33 of the top sheet 13, and the base 50 extends directly rearwardly therefrom, and parallel to the sides 32 and 33, toward the back 31 of the top sheet 13. The base 50 terminates rearwardly at the crossmember 51, to which it is integrally, monolithically, and rigidly formed. The crossmember 51 is transverse to the base 50, extending entirely between the opposed sides 32 and 33, parallel to the front 30. The uprights are also integrally, monolithically, and rigidly formed to the crossmember 51, and extend directly rearwardly from opposed ends thereof, parallel to the sides 32 and 33, to the back 31. The base 50, crossmember 51, and uprights 52 define the forward goal 44. However, the foldable shape 14 also includes the rearward support 45, which is hinged to the forward goal 44. The support 45 extends rearward from the crossmember 51, opposite the base 50. The support 45 includes a member 54 extending backward, parallel to the sides 32 and 33, to a foot 55. The foot 55 flares laterally outward slightly from the member 54 and thus wider than the member 54. The foot 55 includes a bottom 56 and two opposed and oblique leading edges 57 extending between the bottom 56 and the member 54. The bottom 56 is a rearwardly-directed edge of the foldable shape 14 which is flat and parallel to the back 31, while the leading edges 57 are transverse to the back 31 and the sides 32 and 33.

Unlike the uprights 52, the support 45 is not formed integrally, monolithically, and rigidly to the crossmember 51. Rather, it is separated from the crossmember 51. However, it is still flexible with respect to the crossmember 51, because it is joined to the crossmember 51 by the flexible sheets 42 and 43. Indeed, the forward goal is separated from the top sheet 13, but flexible with respect to it, because it is also joined to the top sheet 13 by the flexible sheets 42 and 43.

As shown best in FIG. 1C, a first slender gap or slit 60 spaces the bottom 53 of the base 50 apart from the front 30 of the top sheet 13. The slit 60 extends across the bottom 53, entirely separating the base 50 from the top sheet 13. The slit 60 has a width which is approximately equal to the thickness of the top sheet 13. A second slender gap or slit 61 extends across the member 54, proximate to the top of the crossmember 51, entirely separating the member 54 from the crossmember 51. This slit 61 also has a width which is approximately equal to the thickness of the top sheet 13. These slits 60 and 61 enable flexible movement of the goal 44 and support 45. The flexible sheets 42 and 43 are thin, resilient layers constructed from woven fabric, woven cloth, leather, bicast leather, coated paper, or the like, which are applied over the top sheet 13. The flexible sheet 42 is applied continuously across the top 34 of the top sheet 13, over both the foldable shape 14 and the flat shape 15. Similarly, the flexible sheet 43 is applied continuously under the base sheet 12, under the both the foldable shape 14 and the flat shape 15.

As mentioned above, the profile 35 cuts entirely through the top sheet 13 and the flexible sheets 42 and 43 along the foldable shape 14, but it does not cut through the sheets 42 and 43 at the slits 60 and 61. As such, the flexible sheets 42 and 43 form living hinges 62 and 63 at the slits 60 and 61, respectively, binding the goal 44 to the flat shape 15 and binding the support 45 to the goal 44. The hinge 62 flexes to allow the goal 44 to be raised up away from the base sheet 12, and the hinge 63 flexes to allow the support 45 to be bent down and prop the goal 44 up from behind.

As described above, the profile 35 delineates the foldable shape 14 from the flat shape 15. The foldable shape 14 is defined by the recognizable shape of a football goal in addition to the hidden support 45. The flat shape 15 surrounds the foldable shape 14 and so has a shape which is approximately the negative of the flat shape 15. As can be best seen in FIGS. 1A, 1C, and 1D, the flat shape 15 is the remainder of the top sheet 13 when the foldable shape 14 is lifted up. With the base sheet 12 below it, the flat shape 15 defines channels in the board 10 from which the foldable shape 14 is removed. These channels generally correspond to the foldable shape 14: there is a base channel 70 (in which the base 50 is seated when the foldable shape 14 is in the lowered position), a cross channel 71 (in which the cross member 51 is seated when the foldable shape 14 is in the lowered position), two upright channels 72 (in which the uprights 52 are seated when the foldable shape 14 is in the lowered position), and a support channel 73 (in which the support 45 is seated when the foldable shape 14 is in the lowered position). Each of these channels is just slightly wider than its corresponding piece of the goal 44; a close fit between the foldable shape 14 and the channels in the flat shape 15 ensures that the foldable shape 14 snaps into the channels and is retained in the lowered position, while a loose fit between the foldable shape 14 and the channels in the flat shape 15 would allow the foldable shape 14 to inadvertently come loose from the top sheet 13, possibly incurring damage.

Two semi-circular notches or recesses 74 are formed in the flat shape 15 flanking the support channel 73. This allows the user to grasp the support 45 and pry it upward to initiate movement of the foldable shape 14 from the lowered position to the raised position. In the lowered position of the foldable shape 14, as shown in FIG. 1A, the foldable shape 14 is entirely flat, in continuous and direct contact against the base sheet 12, and its top 34 is contiguous with the top 34 of the top sheet 13, such that, preferably, no part of the foldable shape 14 projects above the top 34. In this way, the foldable shape 14 lies flat and compact, and the notebook 11 can be closed and carried with the user.

To move the foldable shape 14 to the raised position, the user places his fingers into the recesses 74 and grasps the sides of the member 54, gripping the member and pulling it upward and forward toward the front 30 of the top sheet 13. By doing this, the front and back of the foldable shape 14 move toward each other. Preferably, as the foldable shape 14 rises, the bottom 56 of the foot 55 simply slides along the top 34 of the top sheet 13. As the foot 55 slides forward, the goal 44 begins to rise, pushed upward by the member 54 at the living hinge 63. FIG. 1B illustrates the foldable shape 14 just initially being lifted out of the flat shape 15, with the goal 44 just starting to be recognizable. Both of the living hinges 62 and 63 flex to accommodate this movement. The foldable shape 14 moves from the lowered position toward and to the raised position along a single line of movement indicated by the arrowed line A in FIGS. 1B, 1C, and 1D, and the living hinge 63 accommodates movement only along this line A. The leading edges 57 of the foot 55 are oblique to the line A of movement, so that they do not inhibit forward movement of the foot 55.

The bottom 56 of the foot 55 continues to slide toward the front 30 of the top sheet 13 until it drops into the cross channel 71, as shown in FIG. 1C. The cross channel 71 is recessed below the top 34 of the top sheet 13. It is defined between a forwardly-directed edge 75 and an opposed rearwardly-directed edge 76, both parallel to the front 30 of the top sheet 13, and both severed at their middles by the base and support channels 70 and 73.

The forwardly-directed edge 75 defines a stop 80. The forwardly-directed edge 75 projects above the top surface 24 of the base sheet 12, generally normal to the top surface 24, to form an inner corner; this inner corner becomes a stop to rearward movement of a thin object within the cross channel 71. As such, once the bottom 56 of the foot 55 of the member 54 slides into the cross channel 71, it is seated therein and will not inadvertently come out of the cross channel 71 because the rearwardly-directed edge of the bottom 56 encounters the stop 80 and is prevented from rearward movement toward the back 31 of the top sheet 13. Therefore, once the foldable shape 14 is moved into its raised position, as shown in FIGS. 1C and 1D, the bottom 56 of the foot 55 rests against the stop 80, thereby buttressing the member 54 which holds the goal 44 upright, vertical, and facing toward the user.

The user can now play with the game board. The user snaps the game piece 16 out of the top sheet 13. The game piece 16 is a thin, triangular element, which is preferably rigid, strong, and durable, constructed from a material or combination of materials such as thick cardstock, plastic, or even metal. It is seated in a triangular seat 81 in the top sheet 13, closely sized and shaped to snugly receive the game piece 16. Although the drawings show the game piece 16 as triangular, in other embodiments, the game piece 16 may have a flat football shape. In some embodiments, the game piece 16 includes an encapsulated magnet 82, as shown in broken line in FIGS. 1C and 1D, that magnetically engages with a complemental magnet carried in or under the seat 81. Similarly, in some embodiments of the game board 10, the foldable shape 14 includes an engagement element 85, such as a magnet (as shown in broken line in FIG. 1D), embedded in the member 54, and the base sheet 12 includes an embedded complemental engagement element 86, such as a magnet. A recess 84 is formed in communication with the seat 81 so that the user may more easily slip his finger under the game piece 16 and pop it out of the top sheet 13. The user takes the game piece 16 and flicks or throws it through the goal 44 in imitation of a game of football. The user can share the game piece 16 with other players so that they may take turns and compete against one another.

When play is over, the game piece 16 is snappedly returned to its seat 81, and the foldable shape 14 is returned to its lowered position. The user picks the foldable shape 14 up, preferably by grasping the member 54 of the foot 55 between his fingers and lifting up from the top sheet 13, thereby freeing the foot 55 from the stop 80. Once the foot 55 is removed from the stop 80, it can be moved toward the back 31 of the top sheet 13, which cause the member 54 to lie down, and in turn causes the goal 44 to lie down as well. The foot 55 is moved all the way back until it is proximate to the back 31 of the top sheet 13, at which point the support 45 seats into the support channel 73, the uprights 52 seat into the upright channels 72, the cross member 51 seats into the cross channel 71, and the base 50 seats into the base channel 70. In embodiments in which the game board includes complemental engagement elements 85 and 86, the magnetic attraction therebetween holds the foldable shape 14 in the lowered position. The foldable shape 14 is thus returned to and maintained in its lowered position, and the notebook 11 can be closed and carried with the user, for later use. Indeed, all embodiments presented herein may use similar engagement elements to retain the game board in the lowered position, even if not explicitly so stated.

Figure 2A:
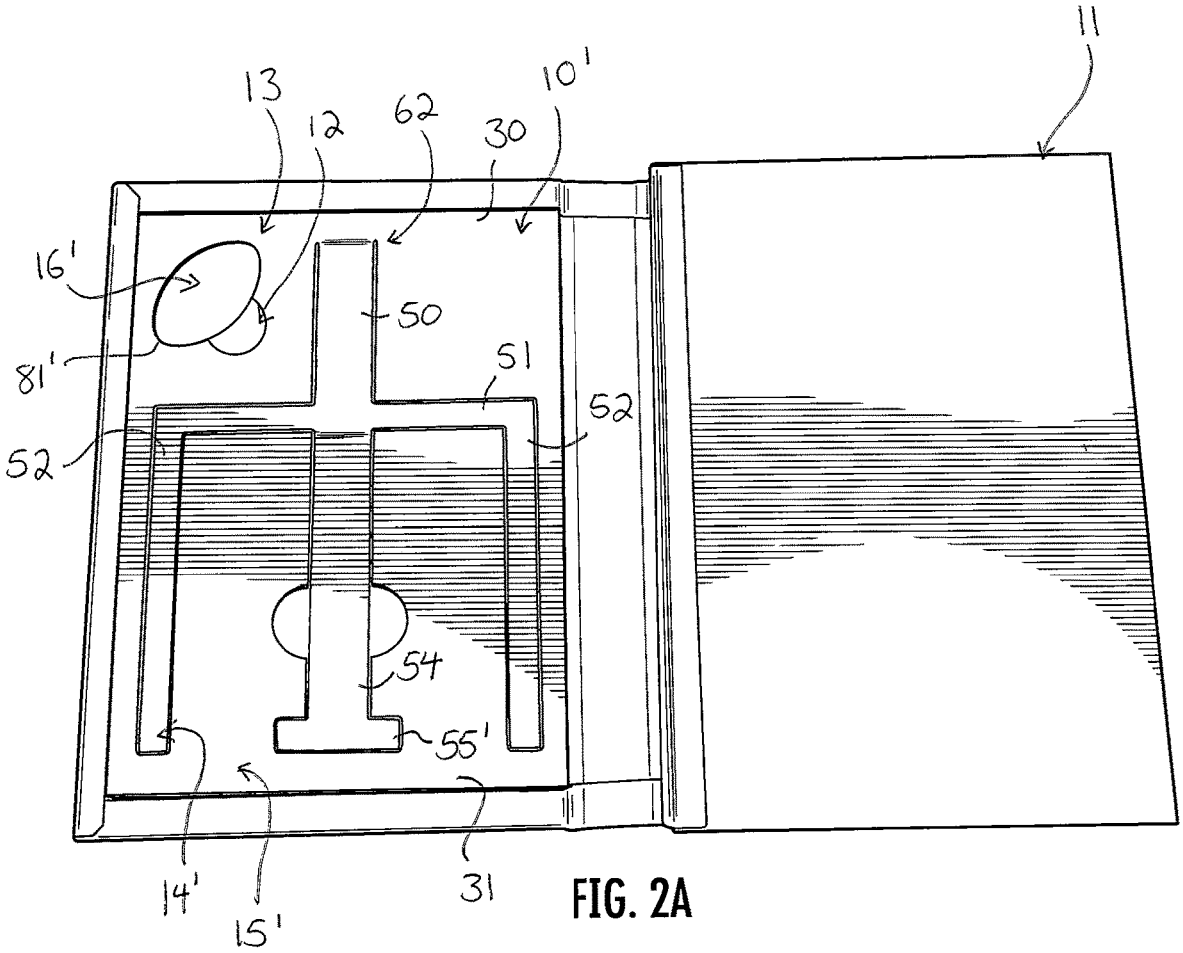
FIGS. 2A and 2B are top perspective views of a game board.
Figure 2B:
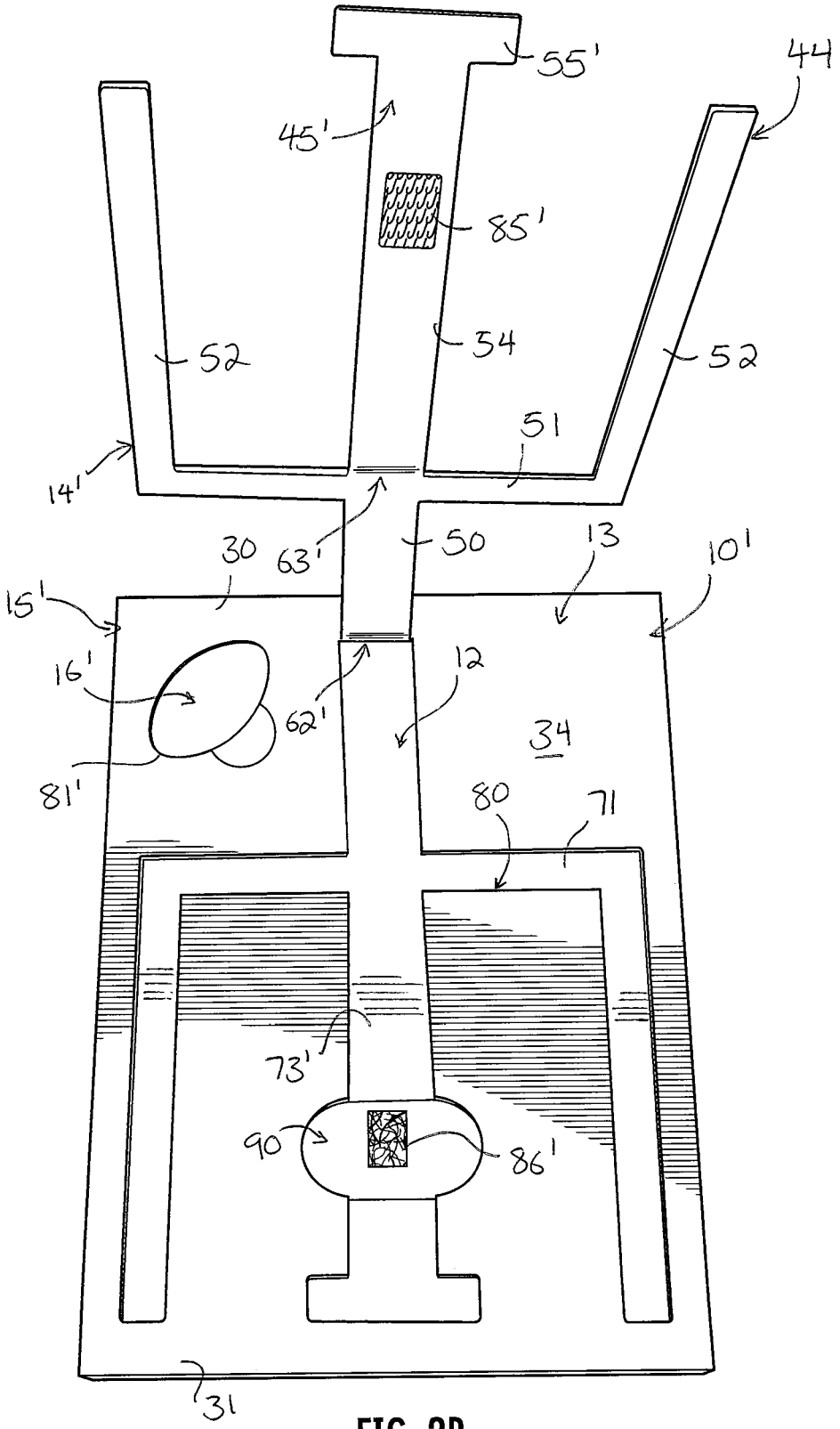

FIGS. 2A and 2B illustrate a game board 10' similar to the game board 10. As such, identical structural elements and features are identified with the same name and reference character. Similar structural elements and features adopt the same name and reference character, but mark the reference character with a prime symbol ("') so as to distinguish them from those of the game board 10. In FIG. 2A, the game board 10' is shown integrated into the notebook 11, while in FIG. 2B it is removed therefrom. The game board 10' includes the base sheet 12 and top sheet 13, but the profile 35 is different, and so the board 10' has a different foldable shape 14' and flat shape 15'.

The foldable shape 14' still includes a base 50, a cross member 51, uprights 52, and a member 54, but the foot 55' is different. The foot 55' is a flat bottom, lacking the diagonal leading edges 57 of the board 10'. Moreover, the foldable shape 14' is smaller than the foldable shape 14, extending not quite to the front 30 and back 31. As such, the living hinge 62 is more easily seen proximate the front 30. The game piece 16' is also slightly different, in the shape of a football or rugby ball instead of a triangular. Its seat 81' corresponds to this different shape, as well. And, as seen in FIG. 2B, the engagement elements 85' and 86' are preferably hook-and-loop style engagement elements, rather than magnetic ones, and so the support channel 73' includes an additional depression 90 to accommodate the thickness of the engagement element 86'.

Operation of the board 10' is substantially similar and so will not be described in detail. The user grasps the sides of the member 54, pulling it upward and forward toward the front 30 of the top sheet 13, causing the foot 55' to emerge from the flat shape 15' and slide along the top 34 of the top sheet 13, until the rearwardly-directed edge of the bottom 56 of the foot 55' drops into the cross channel 71, where it is prevented from rearward movement by the stop 80. FIG. 2B shows the foldable shape 14' in the raised position thereof, except that the support 45' is also raised. This is done for illustrative purposes only to show the engagement element 85' on the underside of the support 45'; in the raised position, the support 45' is down, extending between the hinge 62' and the stop 80, supporting the goal 44 in is upright position. The game piece 16' can then be picked up and flicked through the uprights 52 to play. When play is over, as with the game board 10, the foldable shape 14' is returned to its lowered position and the notebook 11 is closed and taken away.

FIGS. 3A-3D illustrate another embodiment of a game board 110 for playing a football- or rugby-themed game. The board 110 is incorporated into a notebook 111 so that the board 110 is available to the owner at any time the owner becomes bored or desires a distraction; the owner can open the notebook 111, set up the board 110, and play on his own or with other people. By unfolding the board 110, the owner has a set of football or rugby uprights and a play ball that can be thrown or flicked through the uprights, and in seconds the board 110 can be folded back and the notebook 111 carried with the person. The board 110 is durable and constructed to sustain repeated folding and unfolding, so that it lasts for as long as the notebook 111 itself is useful.

The game board 110 includes a base sheet 112 and a top sheet 113 superposed on the base sheet 112 and fixed thereto. The top sheet 113 includes a foldable shape 114 that moves into and out of a flat shape 115, between a lowered position (as shown in FIG. 3A) and a raised position (as shown in FIGS. 3C and 3D) in which the foldable shape 114 forms a goal, so that a game piece 116 can be passed through the goal.

Figure 3A:
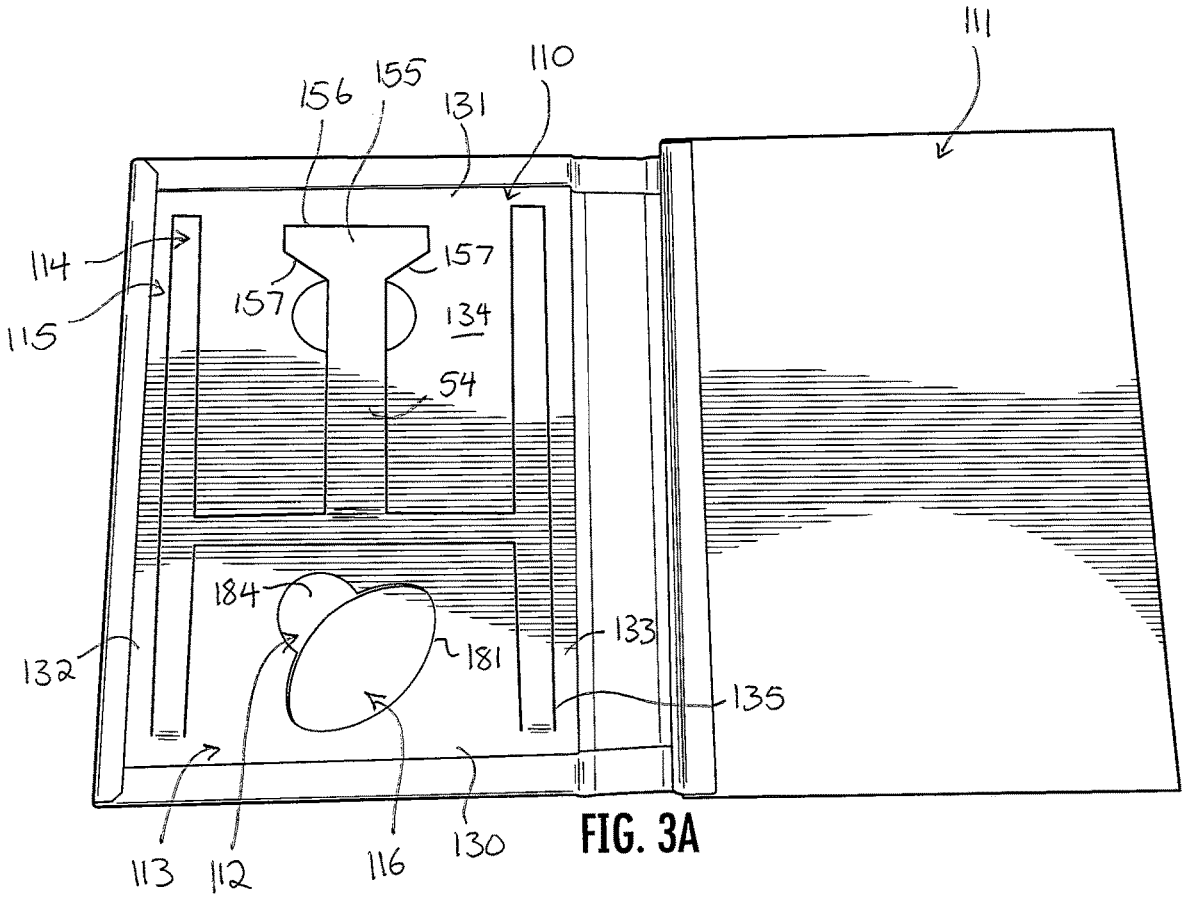
FIG. 3A is a top perspective view of a game board with a foldable shape in a lowered position.
Figure 3B:
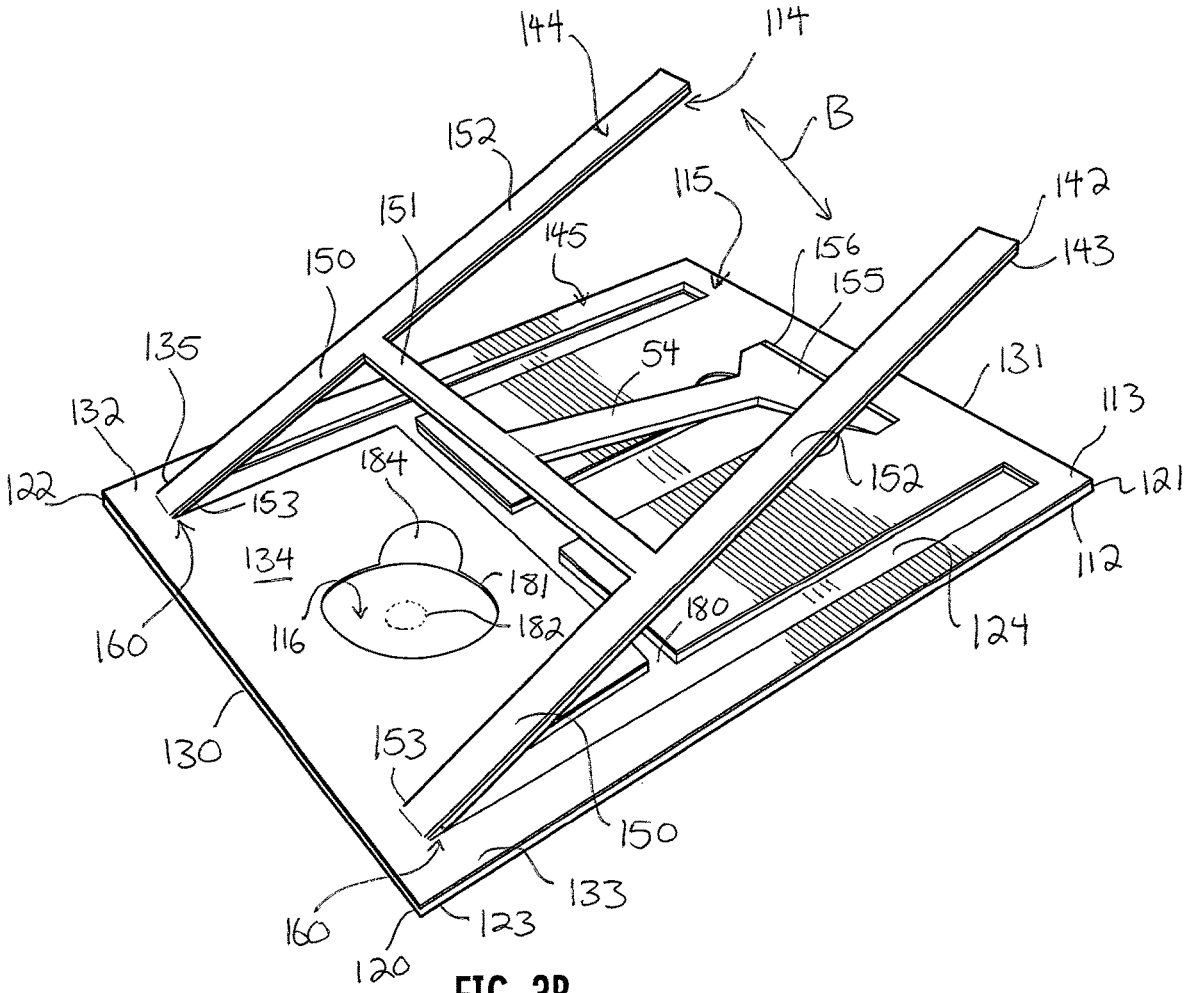
FIGS. 3B-3D are top perspective views of the game board of FIG. 3A, with the foldable shape being raised to a raised position.
Figure 3C:
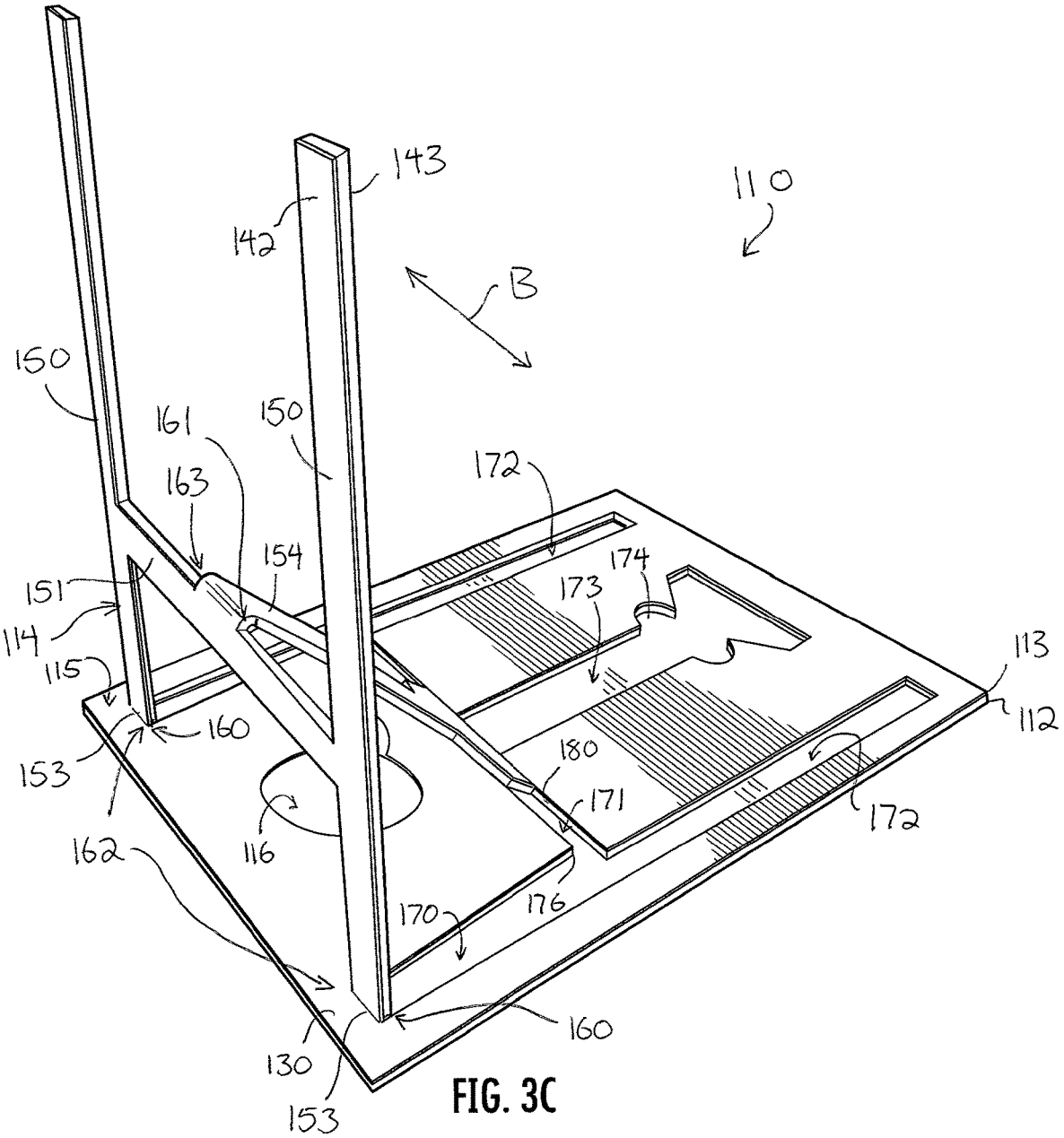
Figure 3D:
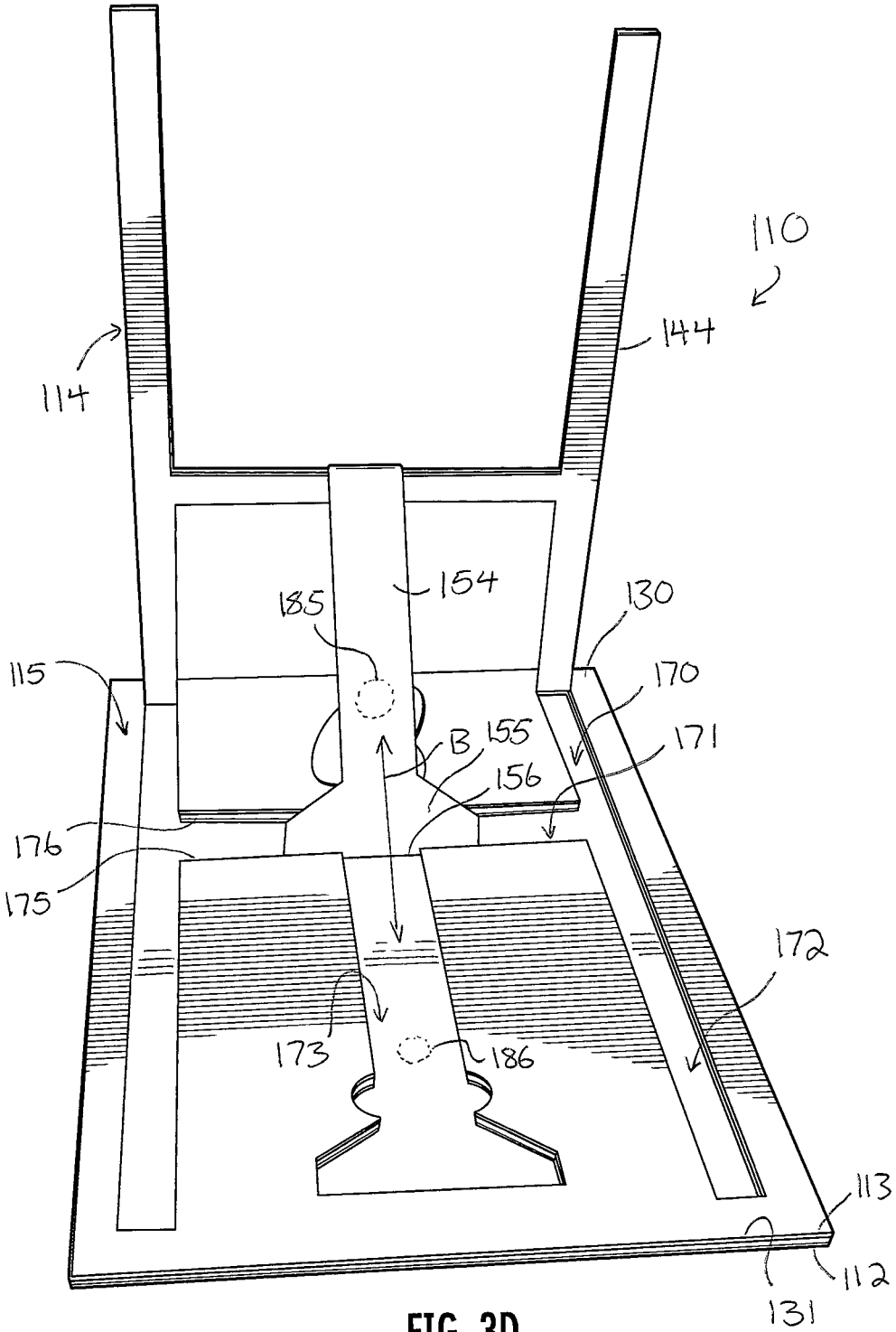

In the embodiment shown in FIGS. 3A-3D, the base sheet 112 is a rigid sheet of material. FIG. 3A, it is shown incorporated into the cover of the notebook 111. In FIGS. 3B-3D, the base sheet 112 is a separate piece of material available to be inserted into the notebook 111. In these drawings, however, the base sheet 112, and indeed, the board 110, is shown as part of the notebook 111.

The base sheet 112 has a front 120, a back 121, and opposed sides 122 and 123. The base sheet 112 has a top and an opposed bottom. The base sheet 112 is rectangular but need not be so limited; in notebooks 111 of different sizes and shapes, the base sheet 112 has different proportions than those shown in the drawings, and where the board 110 is separate from the notebook 111, the base sheet 112 has any suitable size and shape. The base sheet 112, however, is preferably rigid, strong, and durable, constructed from a material or combination of materials such as thick cardstock, plastic, or even metal. The base sheet 112 additionally has a top surface 124 which is exposed in areas in which the foldable shape 114 is lifted up. The top surface 124 is flat, smooth, and continuous between the front 120, back 121, and sides 122 and 123.

The top sheet 113 is carried against this top surface 124 and is coextensive to it. The top sheet 113 is also constructed from a material or combination of materials such as thick cardstock, plastic, or even metal, having rigid, strong, and durable material characteristics. However, the top sheet 113 is cut so that portions of it can be separated from, lifted off of, and arranged with respect to the base sheet 112. In this way, the top sheet 113 forms the goal with which the user plays.

Referring still to FIGS. 3A-3D but primarily to FIGS. 3A and 3B, the top sheet 113 has a front 130, a back 131, opposed sides 132 and 133, a bottom directed toward the top surface 124 of the base sheet 112, and an opposed top 134. The front 130 and back 131 are preferably parallel to each other, and each perpendicular to each of the sides 132 and 133, which in turn are preferably parallel to each other. The top sheet 113 is thin between the bottom and top 134, having a thickness of approximately a few millimeters.

A profile 135 is cut into the top sheet 113. The profile is a cut passing entirely through the top sheet 113 from the top 134 to the bottom. It is continuous around the top sheet 113 so as to define a contour or shape in the top sheet 113. The contour is one of, roughly, a goal and a support for the goal. Indeed, the profile 135 delineates and severs the foldable shape 114 from the flat shape 115. While the foldable shape 114 is lifted and arranged to define the goal as an upstanding object with the support behind it, the flat shape 115 remains flat, in contact with the base sheet 112. The profile 135 is the boundary therebetween, allowing the foldable shape 114 to be entirely separated from and thus lifted above the flat shape 115. Removal of the foldable shape 114, however, is limited by flexible sheets 142 and 143 which are adhered to the top 134 and bottom of the top sheet 113, over both the foldable shape 114 and the flat shape 115. The profile 135 cuts through the flexible sheets 142 and 143 in a corresponding contour to that through the top sheet 113. The flexible sheets 142 and 143 are preferably a fabric, woven cloth, or the like, allowing the foldable shape 114 to move and flex with respect to the flat shape 115; the flexible sheets 142 and 143 are discussed in more detail later.

The foldable shape 114 includes a forward goal 144 and a rearward support 145, where the forward goal 144 is shaped like a football or rugby goal or goalposts. Some football and rugby goals include two vertical posts, a horizontal crossbar, and two vertical uprights spaced apart from each other on the crossbar. Similarly, the goal 144 includes vertical bases 150 at the front of the foldable shape 114, a horizontal crossmember 151, and two vertical uprights 152 and the back of the foldable shape 114, all of which are thin and flat, like the rest of the top sheet 113.

Each base 150 has a bottom 153 proximate to the front 130 of the top sheet 113. The bases 150 and bottoms 153 are disposed at the opposed sides 132 and 133 of the top sheet 113, and the bases 150 extend directly rearwardly therefrom, and parallel to the sides 132 and 133, toward the back 131 of the top sheet 113. The bases 150 terminate rearwardly at the crossmember 151, to which they are integrally, monolithically, and rigidly formed. The crossmember 151 is transverse to the base 150, extending entirely between the opposed sides 132 and 133, parallel to the front 130. The uprights are also integrally, monolithically, and rigidly formed to the crossmember 151, and extend directly rearwardly from opposed ends thereof, parallel to the sides 132 and 133, to the back 131. The bases 150, crossmember 151, and uprights 152 define the forward goal 144. However, the foldable shape 114 also includes the rearward support 145, which is hinged to the forward goal 144. The support 145 extends rearward from the crossmember 151, opposite the bases 150. The support 145 includes a member 154 extending backward, parallel to the sides 132 and 133, to a foot 155. The foot 155 flares laterally outward slightly from the member 154 and thus wider than the member 154. The foot 155 includes a bottom 156 and two opposed and oblique leading edges 157 extending between the bottom 156 and the member 154. The bottom 156 is a rearwardly-directed edge of the foldable shape 114 which is flat and parallel to the back 131, while the leading edges 157 are transverse to the back 131 and the sides 132 and 133.

Unlike the uprights 152, the support 145 is not formed integrally, monolithically, and rigidly to the crossmember 151. Rather, it is separated from the crossmember 151. However, it is still flexible with respect to the crossmember 151, because it is joined to the crossmember 151 by the flexible sheets 142 and 143. Indeed, the forward goal 144 is separated from the top sheet 113, but flexible with respect to it, because it is also joined to the top sheet 113 by the flexible sheets 142 and 143.

Two slender gaps or slits 160 space the bottom 153 of the bases 150 apart from the front 130 of the top sheet 113. Each slit 160 extends across the respective bottom 153, entirely separating each base 150 from the top sheet 113. The slit 160 has a width which is approximately equal to the thickness of the top sheet 113. A second slender gap or slit 161 extends across the member 154, proximate to the top of the crossmember 151, entirely separating the member 154 from the crossmember 151. This slit 161 also has a width which is approximately equal to the thickness of the top sheet 113. These slits 160 and 161 enable flexible movement of the goal 144 and support 145. The flexible sheets 142 and 143 are thin and resilient layers, constructed from fabric, woven cloth, leather, bicast leather, coated paper, or the like, which are applied over the top sheet 113. The flexible sheet 142 is applied continuously across the top 134 of the top sheet 113, over both the foldable shape 114 and the flat shape 115. Similarly, the flexible sheet 143 is applied continuously under the base sheet 112, under the both the foldable shape 114 and the flat shape 115.

As mentioned above, the profile 135 cuts entirely through the top sheet 113 and the flexible sheets 142 and 143 along the foldable shape 114, but it does not cut through the sheets 142 and 143 at the slits 160 and 161. As such, the flexible sheets 142 and 143 form living hinges 162 and 163 at the slits 160 and 161, respectively, binding the goal 144 to the flat shape 115 and binding the support 145 to the goal 144. The hinges 162 flex to allow the goal 144 to be raised up away from the base sheet 112, and the hinge 163 flexes to allow the support 145 to be bent down and prop the goal 144 up from behind.

As described above, the profile 135 delineates the foldable shape 114 from the flat shape 115. The foldable shape 114 is defined by the recognizable shape of a football or rugby goal in addition to the hidden support 145. The flat shape 115 surrounds the foldable shape 114 and so has a shape which is approximately the negative of the flat shape 115. As can be best seen in FIGS. 3A, 3C, and 3D, the flat shape 115 is the remainder of the top sheet 113 when the foldable shape 114 is lifted up. With the base sheet 112 below it, the flat shape 115 defines channels in the board 110 from which the foldable shape 114 is removed. These channels generally correspond to the foldable shape 114: there are two base channels 170 (in which the bases 150 are seated when the foldable shape 114 is in the lowered position), a cross channel 171 (in which the cross member 151 is seated when the foldable shape 114 is in the lowered position), two upright channels 172 (in which the uprights 152 are seated when the foldable shape 114 is in the lowered position), and a support channel 173 (in which the support 145 is seated when the foldable shape 114 is in the lowered position). Each of these channels is just slightly wider than its corresponding piece of the goal 144; a close fit between the foldable shape 114 and the channels in the flat shape 115 ensures that the foldable shape 114 snaps into the channels and is retained in the lowered position, while a loose fit between the foldable shape 114 and the channels in the flat shape 115 would allow the foldable shape 114 to inadvertently come loose from the top sheet 113, possibly incurring damage.

Two semi-circular notches or recesses 174 are formed in the flat shape 115 flanking the support channel 173. This allows the user to grasp the support 145 and pry it upward to initiate movement of the foldable shape 114 from the lowered position to the raised position. In the lowered position of the foldable shape 114, as shown in FIG. 3A, the foldable shape 114 is entirely flat, in continuous and direct contact against the base sheet 112, and its top 134 is contiguous with the top 134 of the top sheet 113, such that, preferably, no part of the foldable shape 114 projects above the top 134. In this way, the foldable shape 114 lies flat and compact, and the notebook 111 can be closed and carried with the user.

To move the foldable shape 114 to the raised position, the user places his fingers into the recesses 174 and grasps the sides of the member 154, gripping the member and pulling it upward and forward toward the front 130 of the top sheet 113. By doing this, the front and back of the foldable shape 114 move toward each other. Preferably, as the foldable shape 114 rises, the bottom 156 of the foot 155 simply slides along the top 134 of the top sheet 113. As the foot 155 slides forward, the goal 144 begins to rise, pushed upward by the member 154 at the living hinge 163. FIG. 3B illustrates the foldable shape 114 just initially being lifted out of the flat shape 115, with the goal 144 just starting to be recognizable. All of the living hinges 162 and 163 flex to accommodate this movement. The foldable shape 114 moves from the lowered position toward and to the raised position along a single line of movement indicated by the arrowed line B in FIGS. 3B, 3C, and 3D, and the living hinge 163 accommodates movement only along this line B. The leading edges 157 of the foot 155 are oblique to the line B of movement, so that they do not inhibit forward movement of the foot 155.

The bottom 156 of the foot 155 continues to slide toward the front 130 of the top sheet 113 until it drops into the cross channel 171, as shown in FIG. 3C. The cross channel 171 is recessed below the top 134 of the top sheet 113. It is defined between a forwardly-directed edge 175 and an opposed rearwardly-directed edge 176, both parallel to the front 130 of the top sheet 113, and both severed at their middles by the base and support channels 170 and 173.

The forwardly-directed edge 175 defines a stop 180. The forwardly-directed edge 175 projects above the top surface 124 of the base sheet 112, generally normal to the top surface 124, to form an inner corner; this inner corner becomes a stop to rearward movement of a thin object within the cross channel 171. As such, once the bottom 156 of the foot 155 of the member 154 slides into the cross channel 171, it is seated therein and will not inadvertently come out of the cross channel 171 because the rearwardly-directed edge of the bottom 156 encounters the stop 180 and is prevented from rearward movement toward the back 131 of the top sheet 113. Therefore, once the foldable shape 114 is moved into its raised position, as shown in FIGS. 3C and 3D, the bottom 156 of the foot 155 rests against the stop 180, thereby buttressing the member 154 which holds the goal 144 upright, vertical, and facing toward the user.

The user can now play with the game board. The user snaps the game piece 116 out of the top sheet 113. The game piece 116 is a thin, oval-shaped element, which is preferably rigid, strong, and durable, constructed from a material or combination of materials such as thick cardstock, plastic, or even metal. It is seated in an oval seat 181 in the top sheet 113, closely sized and shaped to snugly receive the game piece 116. In some embodiments, the game piece 116 includes an encapsulated magnet 182, as shown in broken line in FIG. 3B, that magnetically engages with a complemental magnet carried in or under the seat 181. Similarly, in some embodiments of the game board 110, the foldable shape 114 includes an engagement element 185, such as a magnet (as shown in broken line in FIG. 3D), embedded in the member 154, and the base sheet 112 includes an embedded complemental engagement element 186, such as a magnet. A recess 184 is formed in communication with the seat 181 so that the user may more easily slip his finger under the game piece 116 and pop it out of the top sheet 113. The user takes the game piece 116 and flicks or throws it through the goal 144 in imitation of a game of football or rugby. The user can share the game piece 116 with other players so that they may take turns and compete against one another.

When play is over, the game piece 116 is snappedly returned to its seat 181, and the foldable shape 114 is returned to its lowered position. The user picks the foldable shape 114 up, preferably by grasping the member 154 of the foot 155 between his fingers and lifting up from the top sheet 113, thereby freeing the foot 155 from the stop 180. Once the foot 155 is removed from the stop 180, it can be moved toward the back 131 of the top sheet 113, which cause the member 154 to lie down, and in turn causes the goal 144 to lie down as well. The foot 155 is moved all the way back until it is proximate to the back 131 of the top sheet 113, at which point the support 145 seats into the support channel 173, the uprights 152 seat into the upright channels 172, the cross member 151 seats into the cross channel 171, and the bases 150 seat into the base channels 170. In embodiments in which the game board includes complemental engagement elements 185 and 186, the magnetic attraction therebetween holds the foldable shape 114 in the lowered position. The foldable shape 114 is thus returned to and maintained in its lowered position, and the notebook 111 can be closed and carried with the user, for later use.

FIGS. 4A-4D illustrate another embodiment of a game board 210 for playing a soccer-themed game. The board 210 is incorporated into a notebook 211 so that the board 210 is available to the owner at any time the owner becomes bored or desires a distraction; the owner can open the notebook 211, set up the board 210, and play on his own or with other people. By unfolding the board 210, the owner has a soccer or hockey goal at which he can throw or flick coins or other small articles, and in seconds the board 210 can be folded back and the notebook 211 carried with the person. The board 210 is durable and constructed to sustain repeated folding and unfolding, so that it lasts for as long as the notebook 211 itself is useful.

The game board 210 includes a base sheet 212 and a top sheet 213 superposed on the base sheet 212 and fixed thereto. The top sheet 213 includes a foldable shape 214 that moves into and out of a flat shape 215, between a lowered position (as shown in FIG. 4A) and a raised position (as shown in FIGS. 4C and 4D) in which the foldable shape 214 forms a goal, so that a game piece can be passed through the goal.

Figure 4A:
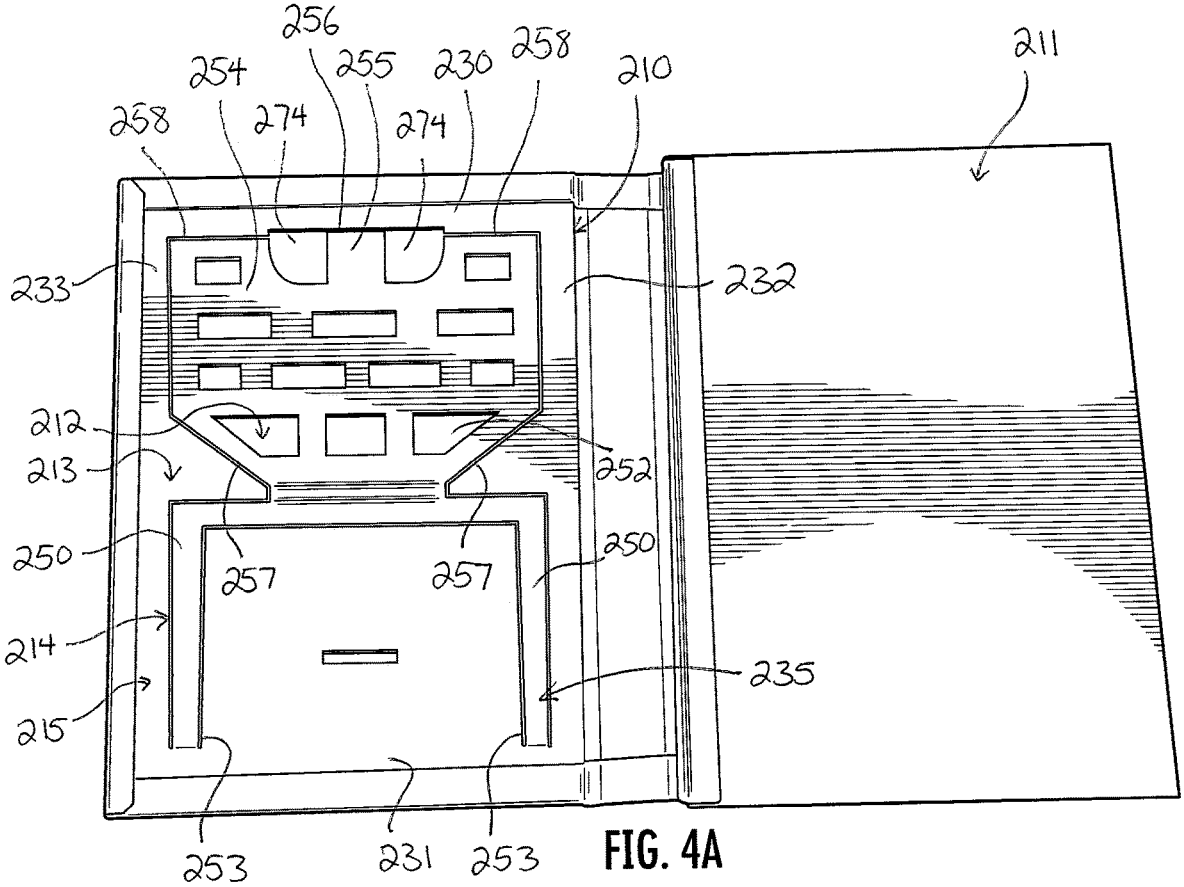
FIG. 4A is a top perspective view of a game board with a foldable shape in a lowered position.
Figure 4B:
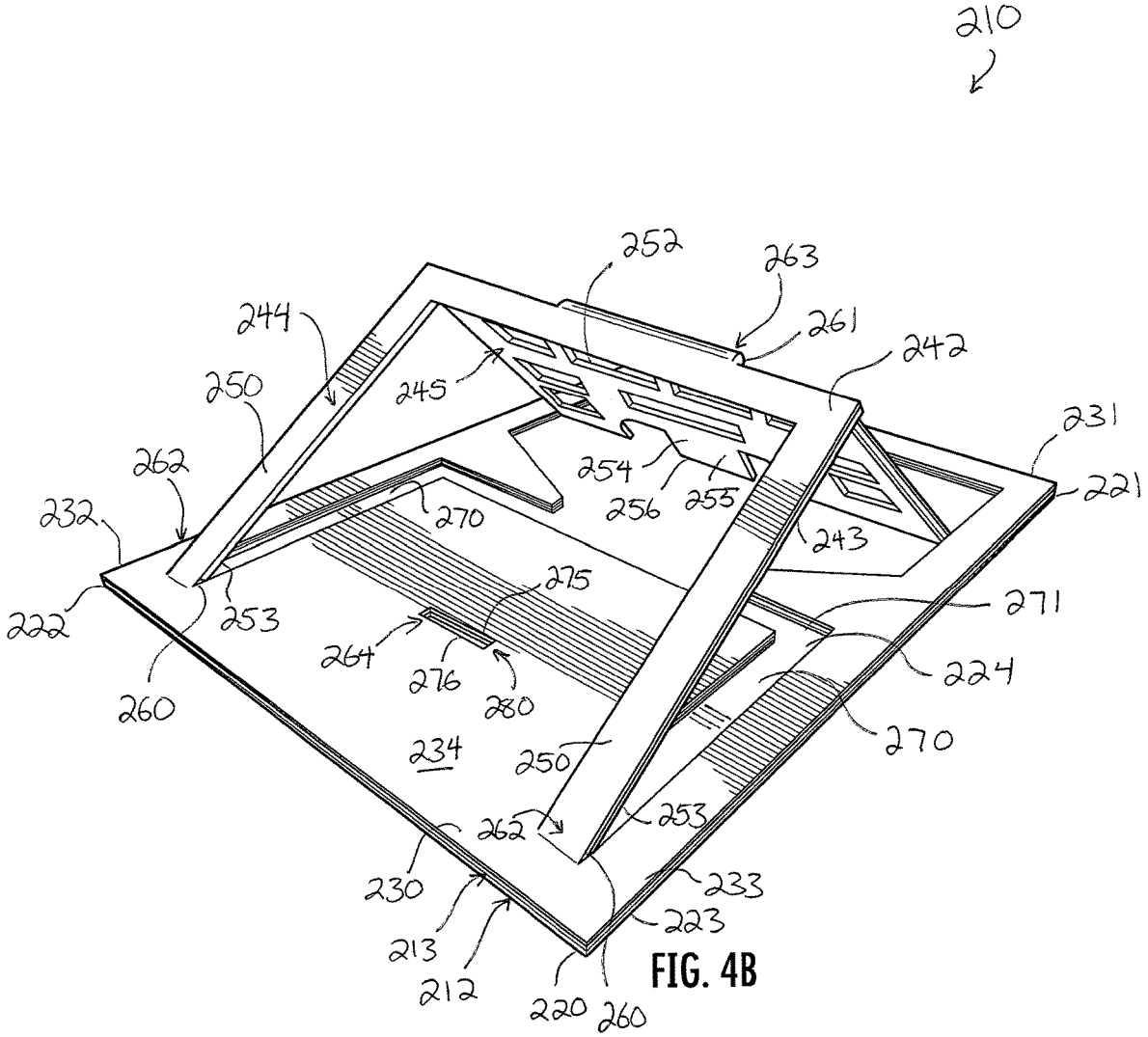
FIGS. 4B-4D are top perspective views of the game board of FIG. 4A, with the foldable shape being raised to a raised position.
Figure 4C:
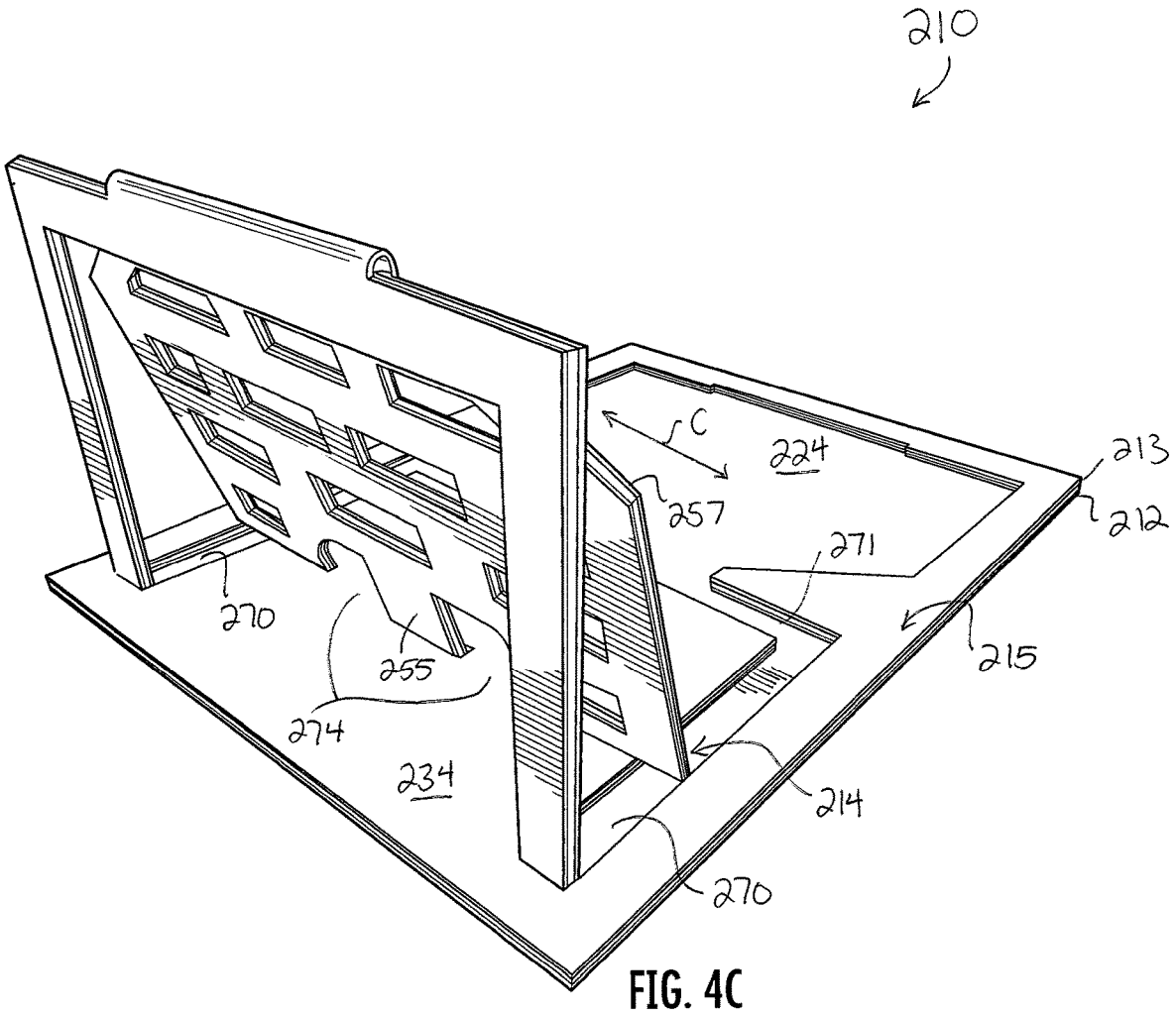
Figure 4D:
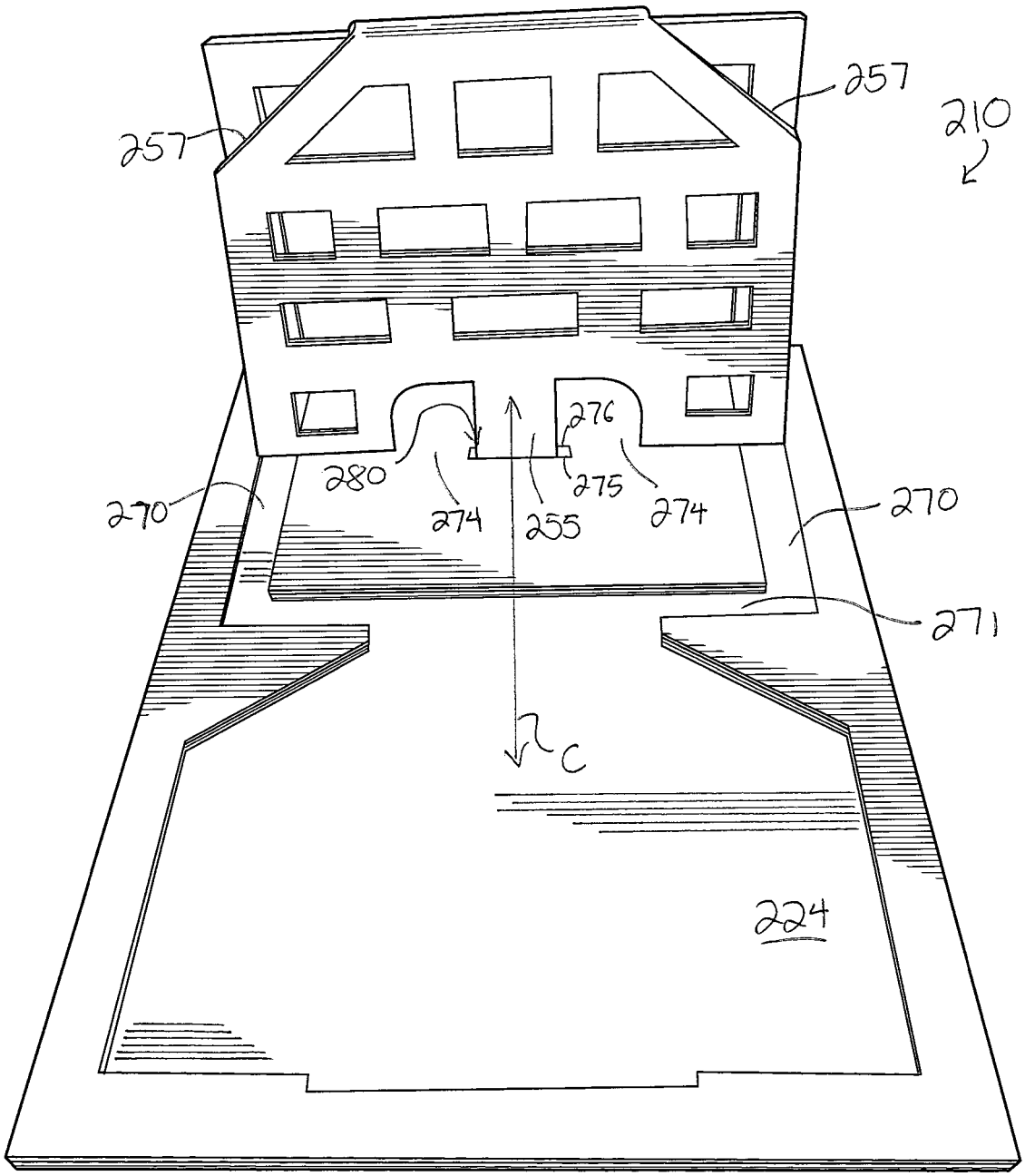

In the embodiment shown in FIGS. 4A-4D, the base sheet 212 is a rigid sheet of material. FIG. 4A, it is shown incorporated into the cover of the notebook 211. In FIGS. 4B-4D, the base sheet 212 is a separate piece of material available to be inserted into the notebook 211. In these drawings, however, the base sheet 212, and indeed, the board 210, is shown as part of the notebook 211.

The base sheet 212 has a front 220, a back 221, and opposed sides 222 and 223. The base sheet 212 has a top and an opposed bottom. The base sheet 212 is rectangular but need not be so limited; in notebooks 211 of different sizes and shapes, the base sheet 212 has different proportions than those shown in the drawings, and where the board 210 is separate from the notebook 211, the base sheet 212 has any suitable size and shape. The base sheet 212, however, is preferably rigid, strong, and durable, constructed from a material or combination of materials such as thick cardstock, plastic, or even metal. The base sheet 212 additionally has a top surface 224 which is exposed in areas in which the foldable shape 214 is lifted up. The top surface 224 is flat, smooth, and continuous between the front 220, back 221, and sides 222 and 223.

The top sheet 213 is carried against this top surface 224 and is coextensive to it. The top sheet 213 is also constructed from a material or combination of materials such as thick cardstock, plastic, or even metal, having rigid, strong, and durable material characteristics. However, the top sheet 213 is cut so that portions of it can be separated from, lifted off of, and arranged with respect to the base sheet 212. In this way, the top sheet 213 forms the goal with which the user plays.

Referring still to FIGS. 4A-4D but primarily to FIGS. 4A and 4B, the top sheet 213 has a front 230, a back 231, opposed sides 232 and 233, a bottom directed toward the top surface 224 of the base sheet 212, and an opposed top 234. The front 230 and back 231 are preferably parallel to each other, and each perpendicular to each of the sides 232 and 233, which in turn are preferably parallel to each other. The top sheet 213 is thin between the bottom and top 234, having a thickness of approximately a few millimeters.

A profile 235 is cut into the top sheet 213. The profile is a cut passing entirely through the top sheet 213 from the top 234 to the bottom. It is continuous around the top sheet 213 so as to define a contour or shape in the top sheet 213. The contour is one of, roughly, a goal and a support for the goal. Indeed, the profile 235 delineates and severs the foldable shape 214 from the flat shape 215. While the foldable shape 214 is lifted and arranged to define the goal as an upstanding object with the support behind it, the flat shape 215 remains flat, in contact with the base sheet 212. The profile 235 is the boundary therebetween, allowing the foldable shape 214 to be entirely separated from and thus lifted above the flat shape 215. Removal of the foldable shape 214, however, is limited by flexible sheets 242 and 243 which are adhered to the top 234 and bottom of the top sheet 213, over both the foldable shape 214 and the flat shape 215. The profile 235 cuts through the flexible sheets 242 and 243 in a corresponding contour to that through the top sheet 213. The flexible sheets 242 and 243 are preferably a fabric, woven cloth, or the like, allowing the foldable shape 214 to move and flex with respect to the flat shape 215; the flexible sheets 242 and 243 are discussed in more detail later.

The foldable shape 214 includes a forward goal 244 and a rearward perforated support 245 that is the net or backstop for the goal 244, where the forward goal 244 is shaped like a soccer or hockey goal. Soccer and hockey goals include two vertical posts, a horizontal crossbar, and a net behind the posts and crossbar. Similarly, the goal 244 includes two opposed vertical posts 250 at the front of the foldable shape 214, a horizontal crossmember 251, and a perforated member 254 extending from the horizontal crossmember 251 rearward, all of which are thin and flat, like the rest of the top sheet 213.

Each post 250 has a bottom 253 proximate to the front 230 of the top sheet 213. The posts 250 and bottoms 253 are disposed at the opposed sides 232 and 233 of the top sheet 213, and the posts 250 extend directly rearwardly therefrom, and parallel to the sides 232 and 233, toward the back 231 of the top sheet 213. The posts 250 terminate rearwardly at the crossmember 251, to which they are integrally, monolithically, and rigidly formed. The crossmember 251 is transverse to the post 250, extending entirely between the opposed sides 232 and 233, parallel to the front 230. The posts 250 and crossmember 251 define the forward goal 244. However, the foldable shape 214 also includes the perforated support 245, which is hinged to the forward goal 244. The support 245 extends rearward from the crossmember 251, along the full width of the crossmember 251. The support 245 is a flat panel perforated with holes 252 throughout to give the appearance and aesthetic of a net. At its top, proximate to the crossmember 251, the support has a pair of opposed leading edges 257 that extend diagonally from the crossmember 251 to the sides of the support 245. The support 245 then extends rearward to a foot 255 and opposed rests 258 flanking the foot 255. The foot 255 is short and directed rearwardly, terminating at a bottom 256. The bottom 256 is a rearwardly-directed edge of the foldable shape 214 which is flat and parallel to the back 231.

The support 245 is separated from the crossmember 251 but is still flexible with respect to the crossmember 251, because it is joined to the crossmember 251 by the flexible sheets 242 and 243. Indeed, the forward goal 244 is actually entirely separated from the top sheet 213, but flexible with respect to it, because it is also joined to the top sheet 213 by the flexible sheets 242 and 243.

Two slender gaps or slits 260 space the bottom 253 of the posts 250 apart from the front 230 of the top sheet 213. Each slit 260 extends across the respective bottom 253, entirely separating each post 250 from the top sheet 213. The slit 260 has a width which is approximately equal to the thickness of the top sheet 213. A second, longer, slender gap or slit 261 extends across the top of the member 254, proximate to the top of the crossmember 251, entirely separating the member 254 from the crossmember 251. This slit 261 also has a width which is approximately equal to the thickness of the top sheet 213. These slits 260 and 261 enable flexible movement of the goal 244 and support 245. The flexible sheets 242 and 243 are thin and resilient layers, constructed from fabric, woven cloth, leather, bicast leather, coated paper, or the like, and which are applied over the top sheet 213. The flexible sheet 242 is applied continuously across the top 234 of the top sheet 213, over both the foldable shape 214 and the flat shape 215. Similarly, the flexible sheet 243 is applied continuously under the base sheet 212, under the both the foldable shape 214 and the flat shape 215.

As mentioned above, the profile 235 cuts entirely through the top sheet 213 and the flexible sheets 242 and 243 along the foldable shape 214, but it does not cut through the sheets 242 and 243 at the slits 260 and 261. As such, the flexible sheets 242 and 243 form living hinges 262 and 263 at the slits 260 and 261, respectively, binding the goal 244 to the flat shape 215 and binding the support 245 to the goal 244. The hinges 262 flex to allow the goal 244 to be raised up away from the base sheet 212, and the hinge 263 flexes to allow the support 245 to be bent down and prop the goal 244 up from behind.

As described above, the profile 235 delineates the foldable shape 214 from the flat shape 215. The foldable shape 214 is defined by the recognizable shape of a soccer or hockey goal. The flat shape 215 surrounds the foldable shape 214 and so has a shape which is approximately the negative of the flat shape 215. As can be best seen in FIGS. 4A, 4C, and 4D, the flat shape 215 is the remainder of the top sheet 213 when the foldable shape 214 is lifted up. With the base sheet 212 below it, the flat shape 215 defines channels in the board 210 from which the foldable shape 214 is removed. These channels generally correspond to the foldable shape 214: there are two post channels 270 (in which the posts 250 are seated when the foldable shape 214 is in the lowered position), a cross channel 271 (in which the cross member 251 is seated when the foldable shape 214 is in the lowered position), and a large support void 273 (in which the support 245 is seated when the foldable shape 214 is in the lowered position). Each of these is just slightly wider than its corresponding piece of the goal 244; a close fit between the foldable shape 214 and the channels in the flat shape 215 ensures that the foldable shape 214 snaps into the channels and is retained in the lowered position, while a loose fit between the foldable shape 214 and the channels in the flat shape 215 would allow the foldable shape 214 to inadvertently come loose from the top sheet 213, possibly incurring damage.

Two quarter-circular notches or recesses 274 are formed into the foldable shape 214 flanking the foot 255. The recesses 274 space the rests 258 apart from the foot 255. This allows the user to grasp the support 245 and pry it upward to initiate movement of the foldable shape 214 from the lowered position to the raised position. In the lowered position of the foldable shape 214, as shown in FIG. 4A, the foldable shape 214 is entirely flat, in continuous and direct contact against the base sheet 212, and its top 234 is contiguous with the top 234 of the top sheet 213, such that, preferably, no part of the foldable shape 214 projects above the top 234. In this way, the foldable shape 214 lies flat and compact, and the notebook 211 can be closed and carried with the user.

To move the foldable shape 214 to the raised position, the user places his fingers into the recesses 274 and grasps the sides of the foot 255, gripping and pulling it upward and forward toward the front 230 of the top sheet 213. By doing this, the front and back of the foldable shape 214 move toward each other. Preferably, as the foldable shape 214 rises, the bottom 256 of the foot 255 simply slides along the top 234 of the top sheet 213. As the foot 255 slides forward, the goal 244 begins to rise, pushed upward by the member 254 at the living hinge 263. FIG. 4B illustrates the foldable shape 214 just initially being lifted out of the flat shape 215, with the goal 244 just starting to be recognizable. All of the living hinges 262 and 263 flex to accommodate this movement. The foldable shape 214 moves from the lowered position toward and to the raised position along a single line of movement indicated by the arrowed line C in FIGS. 4C and 4D, and the living hinge 263 accommodates movement only along this line C. The leading edges 257 are oblique to the line C of movement, so that they do not inhibit forward movement of the foot 255.

The bottom 256 of the foot 255 continues to slide toward the front 230 of the top sheet 213; it drops into the cross channel 271, but is moved out of the cross channel 271 and forwardly until it drops into a slot 264 formed entirely through the base sheet 213. The slot 264 is elongate, oriented between the sides 222 and 223, and centered with respect to them. The slot 264 is defined by a forwardly-directed edge 275 and an opposed rearwardly-directed edge 276, both parallel to the front 230 of the top sheet 213. The slot 264 closely receives the foot 255.

The forwardly-directed edge 275 defines a stop 280. The forwardly-directed edge 275 projects above the top surface 224 of the base sheet 212, generally normal to the top surface 224, to form an inner corner; this inner corner becomes a stop to rearward movement of a thin object within the slot 264. As such, once the bottom 256 of the foot 255 of the member 254 slides into the slot 264, it is seated therein and will not inadvertently come out of the slot 264 because the rearwardly-directed edge of the bottom 256 encounters the stop 280 and is prevented from rearward movement toward the back 231 of the top sheet 213. Therefore, once the foldable shape 214 is moved into its raised position, as shown in FIGS. 4C and 4D, the bottom 256 of the foot 255 rests against the stop 280, thereby buttressing the member 254 which holds the goal 244 upright, vertical, and facing toward the user.

The user can now play with the game board. The user can throw, flick, or slide coins, pebbles, erasers, and other small items toward the goal 244. The user can share the game piece with other players so that they may take turns and compete against one another. When play is over, the foldable shape 214 is returned to its lowered position. The user picks the foldable shape 214 up, preferably by grasping the member 254 of the foot 255 between his fingers and lifting up from the top sheet 213, thereby freeing the foot 255 from the stop 280. Once the foot 255 is removed from the stop 280, it can be moved toward the back 231 of the top sheet 213, which cause the member 254 to lie down, and in turn causes the goal 244 to lie down as well. The foot 255 is moved all the way back until it is proximate to the back 231 of the top sheet 213, at which point the support 245 seats into the support void 273, the cross member 251 seats into the cross channel 271, and the posts 250 seat into the post channels 270. The foldable shape 214 is thus returned to and maintained in its lowered position, and the notebook 211 can be closed and carried with the user, for later use.

Figure 5A:
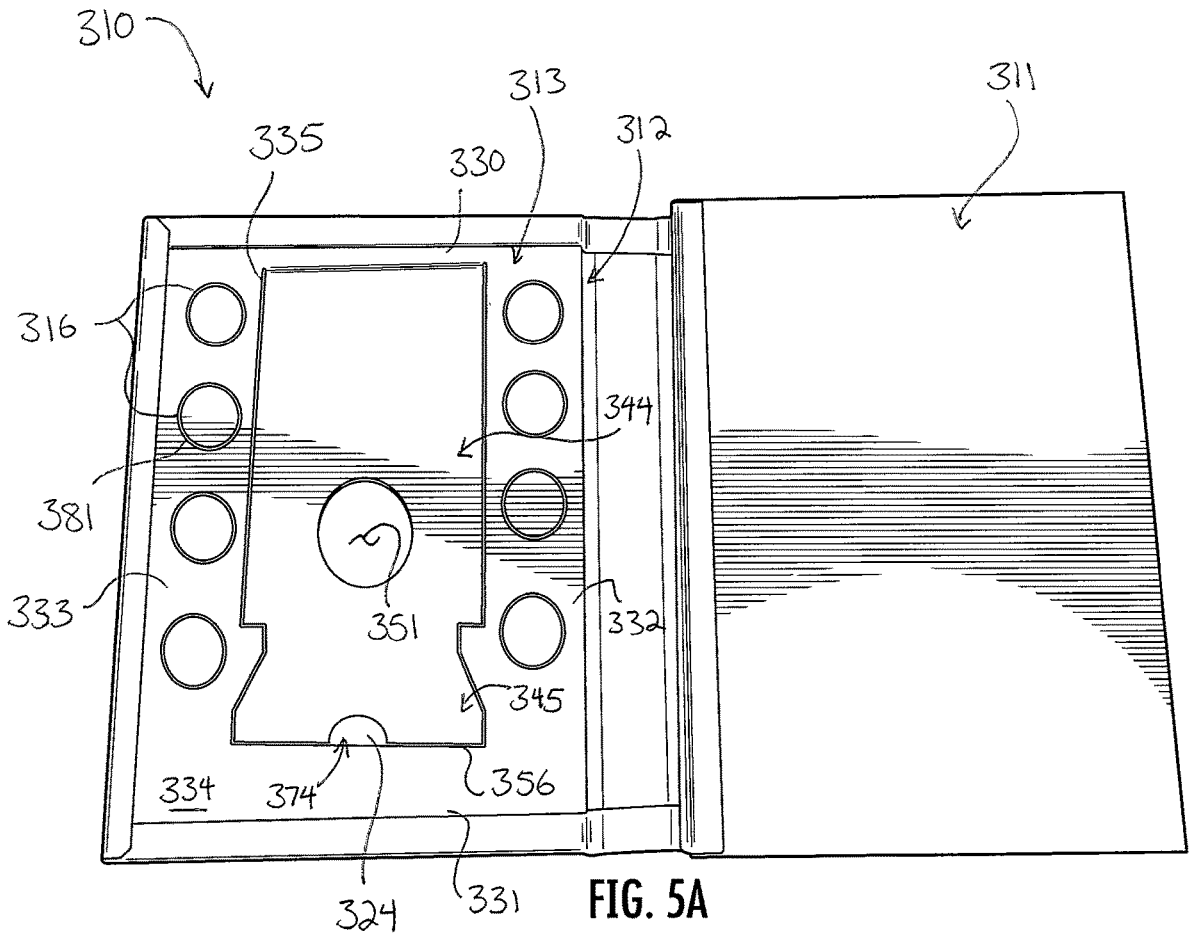
FIG. 5A is a top perspective view of a game board with a foldable shape in a lowered position.
Figure 5B:
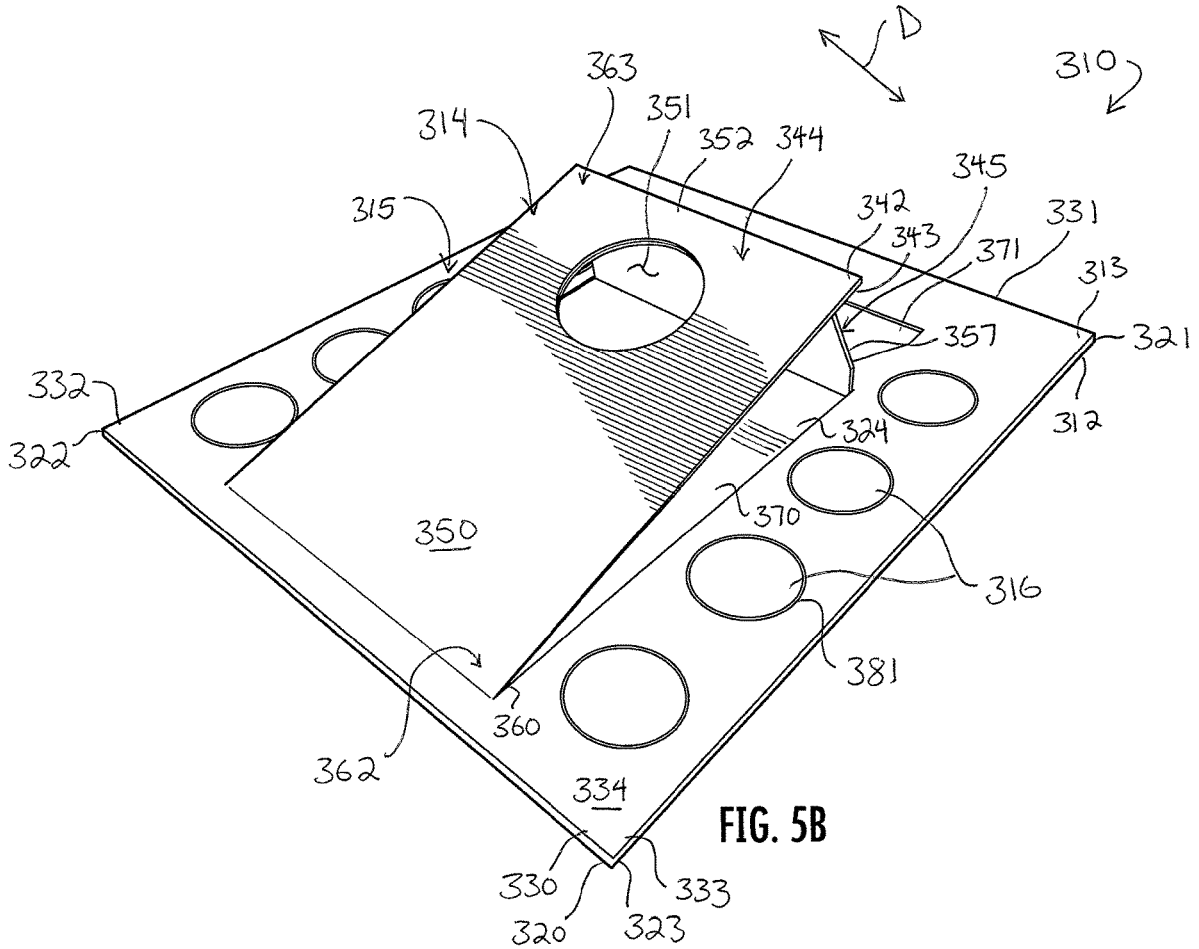
FIGS. 5B and 5C are top perspective views of the game board of FIG. 5A, with the foldable shape being raised to a raised position.
Figure 5C:
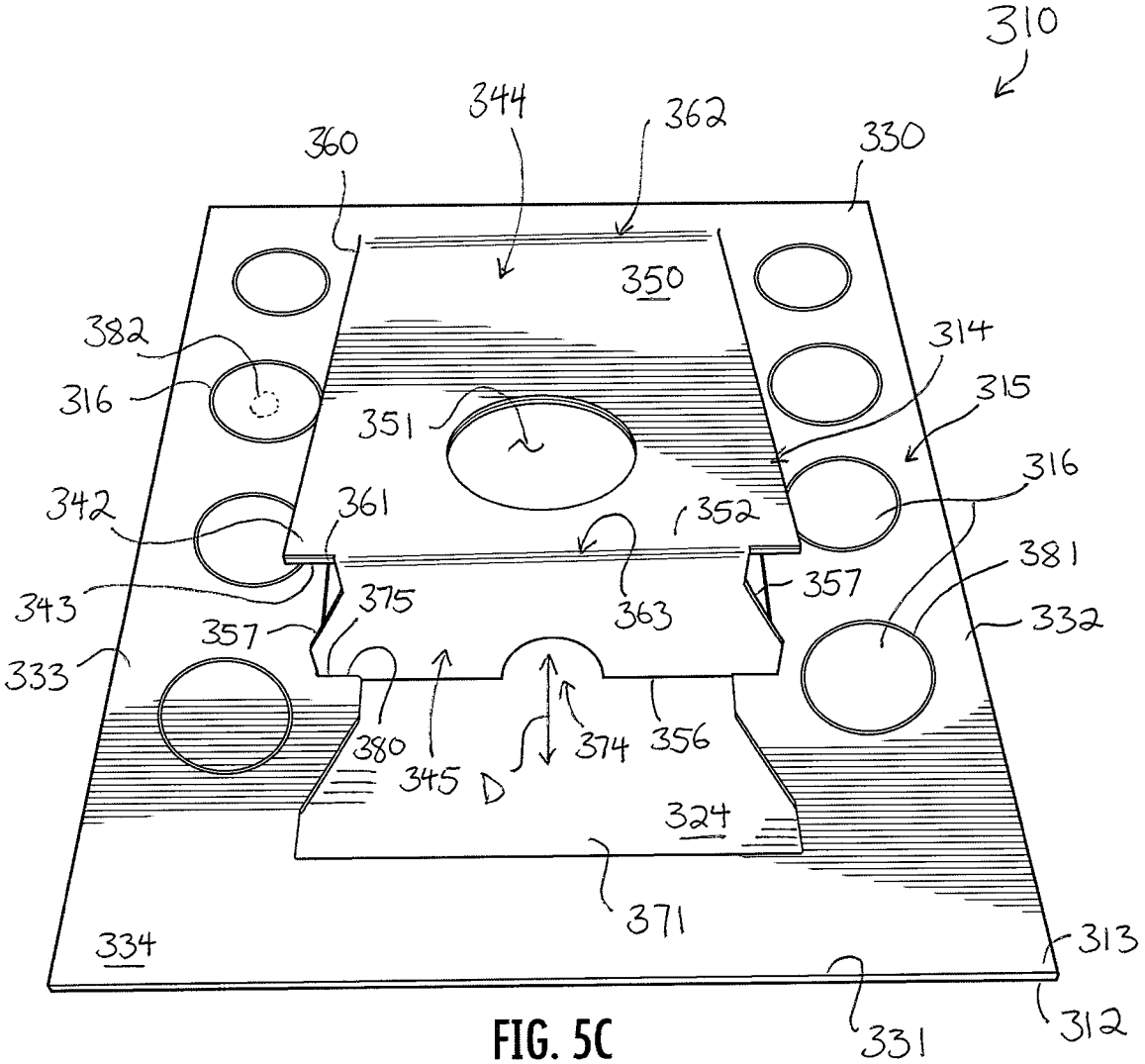

FIGS. 5A-5C illustrate another embodiment of a game board 310 for playing a game similar to cornhole also known as bean bag toss. In FIG. 5A, the board 310 is shown incorporated into a notebook 311 so that the board 310 is available to the owner at any time the owner becomes bored or desires a distraction; the owner can open the notebook 311, set up the board 310, and play on his own or with other people. By unfolding the board 310, the owner has a cornhole board and a set of "bags" or discs that can be tossed or flicked at the board, attempting to deliver the disc through the through a hole in the board. If needed, in seconds the board 310 can be folded back and the notebook 311 carried with the person. The board 310 is durable and constructed to sustain repeated folding and unfolding, so that it lasts for as long as the notebook 311 itself is useful. Though the drawings show discs as the game piece, and the description here refers to them, in other embodiments small bags are used as the game piece.

The game board 310 includes a base sheet 312 and a top sheet 313 superposed on the base sheet 312 and fixed thereto. The top sheet 313 includes a foldable shape 314 that moves into and out of a flat shape 315, between a lowered position (as shown in FIG. 5A) and a raised position (as shown in FIGS. 5B and 5C) in which the foldable shape 314 forms a goal, so that a game piece 316 can be thrown at the goal.

In the embodiment shown in FIG. 5A, the base sheet 312 is a rigid sheet of material forming the cover of the notebook 311. As shown in FIGS. 5B and 5C, however, the board 310 is separated from the notebook 311 but is still available to be inserted into the notebook 311. In FIG. 5A, the base sheet 312 is mostly hidden from view under the top sheet 313, but it can be seen in places where the foldable shape 314 has holes therethrough. As such, names and reference characters for various structural elements and features of the base sheet 312 will be identified but may not be visible; nevertheless, one having ordinary skill in the art should be able to readily understand them, given they are basic parts. For instance, the base sheet 312 has a front 320, a back 321, and opposed sides 322 and 323. The base sheet 312 has a top and an opposed bottom. The base sheet 312 is rectangular but need not be so limited; in notebooks 311 of different sizes and shapes, the base sheet 312 has different proportions than those shown in the drawings, and where the board 310 is entirely separate from the notebook 311, the base sheet 312 has any suitable size and shape. The base sheet 312, however, is preferably rigid, strong, and durable, constructed from a material or combination of materials such as thick cardstock, plastic, or even metal. The base sheet 312 additionally has a top surface 324 which is exposed in areas in which the foldable shape 314 is lifted up. The top surface 324 is flat, smooth, and continuous between the front 320, back 321, and sides 322 and 323.

The top sheet 313 is carried against this top surface 324. The top sheet 313 is also constructed from a material or combination of materials such as thick cardstock, plastic, or even metal, having rigid, strong, and durable material characteristics. However, the top sheet 313 is cut so that portions of it can be separated from, lifted off of, and arranged with respect to the base sheet 312. In this way, the top sheet 313 forms the goal with which the user plays.

Referring still to FIGS. 5A-5C, the top sheet 313 has a front 330, a back 331, opposed sides 332 and 333, a bottom directed toward the top surface 324 of the base sheet 312, and an opposed top 334. The front 330 and back 331 are preferably parallel to each other, and each perpendicular to each of the sides 332 and 333, which in turn are preferably parallel to each other. The top sheet 313 is thin between the bottom and top 334, having a thickness of approximately a few millimeters.

A profile 335 is cut into the top sheet 313. The profile 335 is a cut passing entirely through the top sheet 313 from the top 334 to the bottom. It is continuous around the top sheet 313 so as to define a contour or shape in the top sheet 313. The contour is one of, roughly, a cornhole goal and a support for that goal. Indeed, the profile 335 delineates and severs the foldable shape 314 from the flat shape 315. While the foldable shape 314 is lifted and arranged to define the goal as an upstanding object with the support behind it, the flat shape 315 remains flat, in contact with the base sheet 312. The profile 335 is the boundary therebetween, allowing the foldable shape 314 to be entirely separated from and thus lifted above the flat shape 315. Removal of the foldable shape 314, however, is limited by flexible sheets 342 and 343 which are adhered to the top 334 and bottom of the top sheet 313, over both the foldable shape 314 and the flat shape 315. The profile 335 cuts through the flexible sheets 342 and 343 in a corresponding contour to that through the top sheet 313. The flexible sheets 342 and 343 are preferably a fabric, woven cloth, or the like, allowing the foldable shape 314 to move and flex with respect to the flat shape 315; the flexible sheets 342 and 343 are discussed in more detail below.

In the embodiment shown in FIGS. 5A-5C, the foldable shape 314 includes a forward goal 344 and a rearward support 345, where the forward goal 344 is shaped like a cornhole goal. A cornhole goal includes a low-angle face with a hole formed therethrough. Similarly, the goal 344 includes a face 350, which is an upwardly- or outwardly-facing face of the foldable shape 314, and a hole 351 formed near a top 352 of the face 350. The hole 351 is formed entirely through the face 350 and is the primary target when the user is throwing the game piece 316.

The face 350 further includes a bottom 353, opposite the top 352, proximate to the front 330 of the top sheet 313. The bottom 353—and the face 350—are disposed intermediate with respect to the opposed sides 332 and 333 of the top sheet 313, and the face 350 extends directly rearwardly therefrom, and parallel to the sides 332 and 333, toward the back 331 of the top sheet 313. The face 350 terminates rearwardly at its top 352.

From the top 352 of the face 350, the support 345 continues backward. The support 345 extends directly rearwardly from the top 352, parallel to the sides 332 and 333, toward the back 331. The support 345 flares laterally outward slightly from a narrowed portion proximate the top 352 of the face 350. The support 345 includes a bottom 356 and two opposed and oblique leading edges 357 extending between narrowed portion of the support 345 and the bottom 356. The bottom 356 is a rearwardly-directed edge of the foldable shape 314 which is flat and parallel to the back 331, while the leading edges 357 are transverse to the back 331 and the sides 332 and 333.

The support 345 is separated from the face 350, but is flexible with respect to it, because it is joined to the face 350 by the flexible sheets 342 and 343. Indeed, the forward goal is separated from the top sheet 313, but flexible with respect to it, because it is also joined to the top sheet 313 by the flexible sheets 342 and 343.

A first slender gap or slit 360 spaces the bottom 353 of the face 350 apart from the front 330 of the top sheet 313. The slit 360 extends across the bottom 353, entirely separating the face 350 from the top sheet 313. The slit 360 has a width which is approximately equal to the thickness of the top sheet 313. A second slender gap or slit 361 extends across the top 352 of the face 350, entirely separating the face from the support 345. This slit 361 also has a width which is approximately equal to the thickness of the top sheet 313. These slits 360 and 361 enable flexible movement of the goal 344 and support 345. The flexible sheets 342 and 343 are thin and resilient, constructed from fabric, woven cloth, leather, bicast leather, coated paper, or the like, and which are applied over the top sheet 313. The flexible sheet 342 is applied continuously across the top 334 of the top sheet 313, over both the foldable shape 314 and the flat shape 315. Similarly, the flexible sheet 343 is applied continuously under the base sheet 312, under the both the foldable shape 314 and the flat shape 315.

As mentioned above, the profile 335 cuts entirely through the top sheet 313 and the flexible sheets 342 and 343 along the foldable shape 314, but it does not cut through the sheets 342 and 343 at the slits 360 and 361. As such, the flexible sheets 342 and 343 form living hinges 362 and 363 at the slits 360 and 361, respectively, binding the goal 344 to the flat shape 315 and binding the support 345 to the goal 344. The hinge 362 flexes to allow the goal 344 to be raised up away from the base sheet 312, and the hinge 363 flexes to allow the support 345 to be bent down and prop the goal 344 up from behind.

The profile 335 delineates the foldable shape 314 from the flat shape 315. The foldable shape 314 is defined by the shape of a cornhole goal. The flat shape 315 surrounds the foldable shape 314 and so has a shape which is approximately the negative of the flat shape 315. As can be best seen in FIGS. 5B and 5C, the flat shape 315 is the remainder of the top sheet 313 when the foldable shape 314 is lifted up. With the base sheet 312 below it, the flat shape 315 defines two main channels in the board 310 from which the foldable shape 314 is removed. These channels generally correspond to the foldable shape 314: there is a base channel 370 (in which the face 350 is seated when the foldable shape 314 is in the lowered position) and a support channel 371 (in which the support 345 is seated when the foldable shape 314 is in the lowered position). Each of these channels is just slightly wider than its corresponding piece of the goal 344; a close fit between the foldable shape 314 and the channels in the flat shape 315 ensures that the foldable shape 314 snaps into the channels and is retained in the lowered position, while a loose fit between the foldable shape 314 and the channels in the flat shape 315 would allow the foldable shape 314 to inadvertently come loose from the top sheet 313, possibly incurring damage.

A semi-circular notch or recess 374 is formed into the support 345, severing the bottom 365. This allows the user to grasp the support 345 and pry it upward to initiate movement of the foldable shape 314 from the lowered position to the raised position. In the lowered position of the foldable shape 314, as shown in FIG. 5A, the foldable shape 314 is entirely flat, in continuous and direct contact against the base sheet 312, and its top 334 is contiguous with the top 334 of the top sheet 313, such that, preferably, no part of the foldable shape 314 projects above the top 334. In this way, the foldable shape 314 lies flat and compact, and the notebook 311 can be closed and carried with the user.

To move the foldable shape 314 to the raised position, the user places his fingers into the recess 374 and pulls upward and forward toward the front 330 of the top sheet 313. By doing this, the front and back of the foldable shape 314 move toward each other. Preferably, as the foldable shape 314 rises, the bottom 356 of the support 345 simply slides along the top 334 of the top sheet 313. As the support 345 slides forward, the goal 344 begins to rise, pushed upward by the member 54 at the living hinge 363. Both of the living hinges 362 and 363 flex to accommodate this movement. The foldable shape 314 moves from the lowered position toward and to the raised position along a single line of movement indicated by the arrowed line D in FIGS. 5B and 5C, and the living hinge 363 accommodates movement only along this line D. The leading edges 357 of the support 345 are oblique to the line D of movement, so that they do not inhibit forward movement of the support 345.

The bottom 356 of the support 345 continues to slide toward the front 330 of the top sheet 313 until it drops into the base channel 370, as shown in FIGS. 5B and 5C. The base channel 370 is recessed below the top 334 of the top sheet 313. It is defined between a forwardly-directed edge 375 and the bottom 353 of the face 350, both parallel to the front 330 of the top sheet 313. The forwardly-directed edge 375 is widely severed at its middle by an opening communicating with the support channel 371.

The forwardly-directed edge 375 defines a stop 380. The forwardly-directed edge 375 projects above the top surface 324 of the base sheet 312, generally normal to the top surface 324, to form an inner corner; this inner corner becomes a stop to rearward movement of a thin object within the cross channel 371. As such, once the bottom 356 of the support 345 of the member 54 slides into the base channel 370, it is seated therein and will not inadvertently come out of the base channel 370 because the rearwardly-directed edge of the bottom 356 encounters the stop 380 and is prevented from rearward movement toward the back 331 of the top sheet 313. Therefore, once the foldable shape 314 is moved into its raised position, as shown in FIGS. 5B and 5C, the bottom 356 of the support 345 rests against the stop 380, thereby buttressing the support 345 which holds the goal 344 upright, vertical, and facing toward the user.

The user can now play with the game board. The user snaps any or all of the game pieces 316 out of the top sheet 313. The game pieces 316 are each thin, disc-shaped element, preferably rigid, strong, and durable, and constructed from a material or combination of materials such as thick cardstock, plastic, or even metal (though, again, some embodiments use bags instead of discs). Each is seated in a circular seat 381 in the top sheet 313, closely sized and shaped to snugly receive the game piece 316. In some embodiments, the game piece 316 includes an encapsulated magnet 382, as shown in broken line in FIG. 5C, that magnetically engages with a complemental magnet carried in or under the seat 81. The user takes the game piece 316 and flicks or throws it at the goal 344 with an aim to deliver the game piece 316 through the hole 351 in imitation of a game of cornhole. The user can share the game piece 316 with other players so that they may take turns and compete against one another.

When play is over, the game piece 316 is snappedly returned to its seat 381, and the foldable shape 314 is returned to its lowered position. The user picks the foldable shape 314 up, preferably by grasping the support 345 between his fingers and lifting up from the top sheet 313, thereby freeing the support 345 from the stop 380. Once the support 345 is removed from the stop 380, it can be moved toward the back 331 of the top sheet 313, which causes the support 345 to lie down, and in turn causes the goal 344 to lie down as well. The support 345 is moved all the way back until it is proximate to the back 331 of the top sheet 313, at which point the support 345 seats into the support channel 371 and the face 350 seats into the base channel 370. The foldable shape 314 is thus returned to and maintained in its lowered position, and the notebook 311 can be closed and carried with the user, for later use.

Figure 6A:
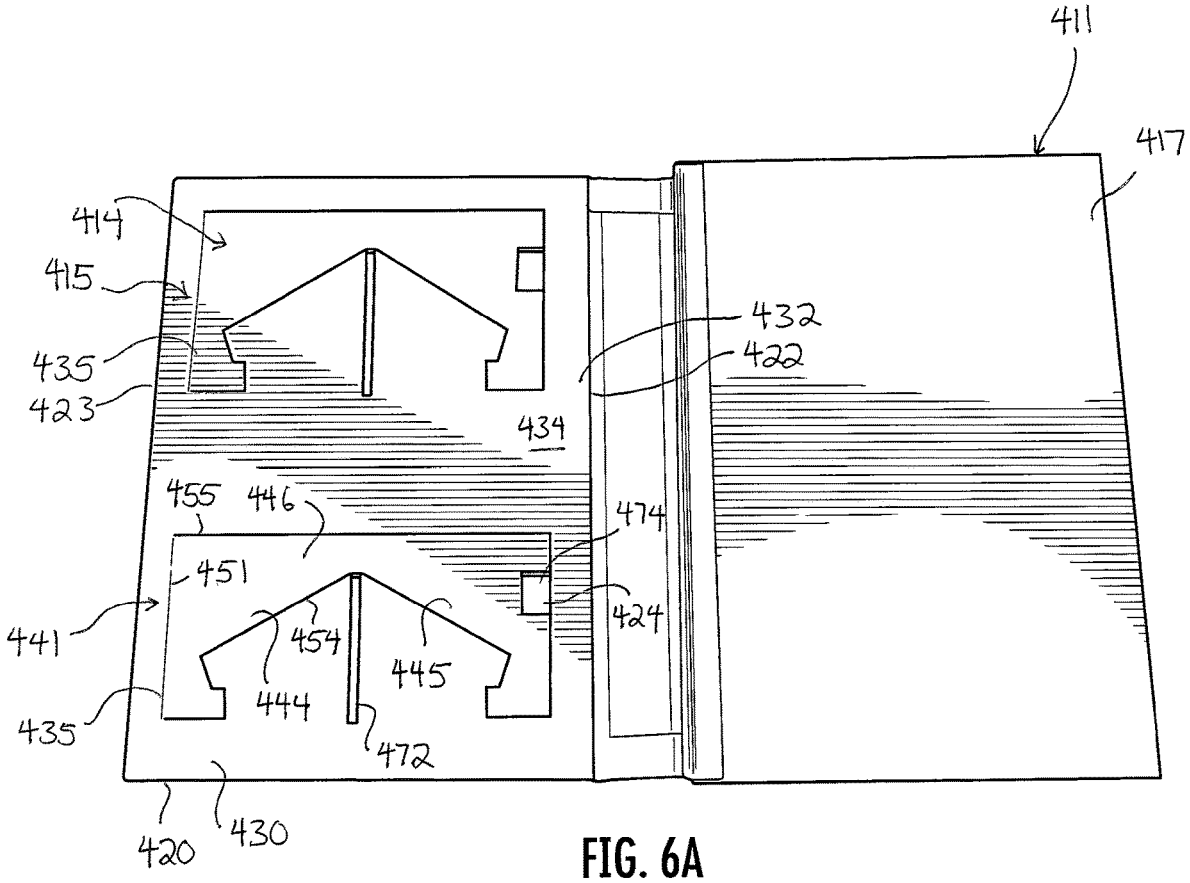
FIG. 6A is a top perspective view of a game board with a foldable shape in a lowered position.
Figure 6B:
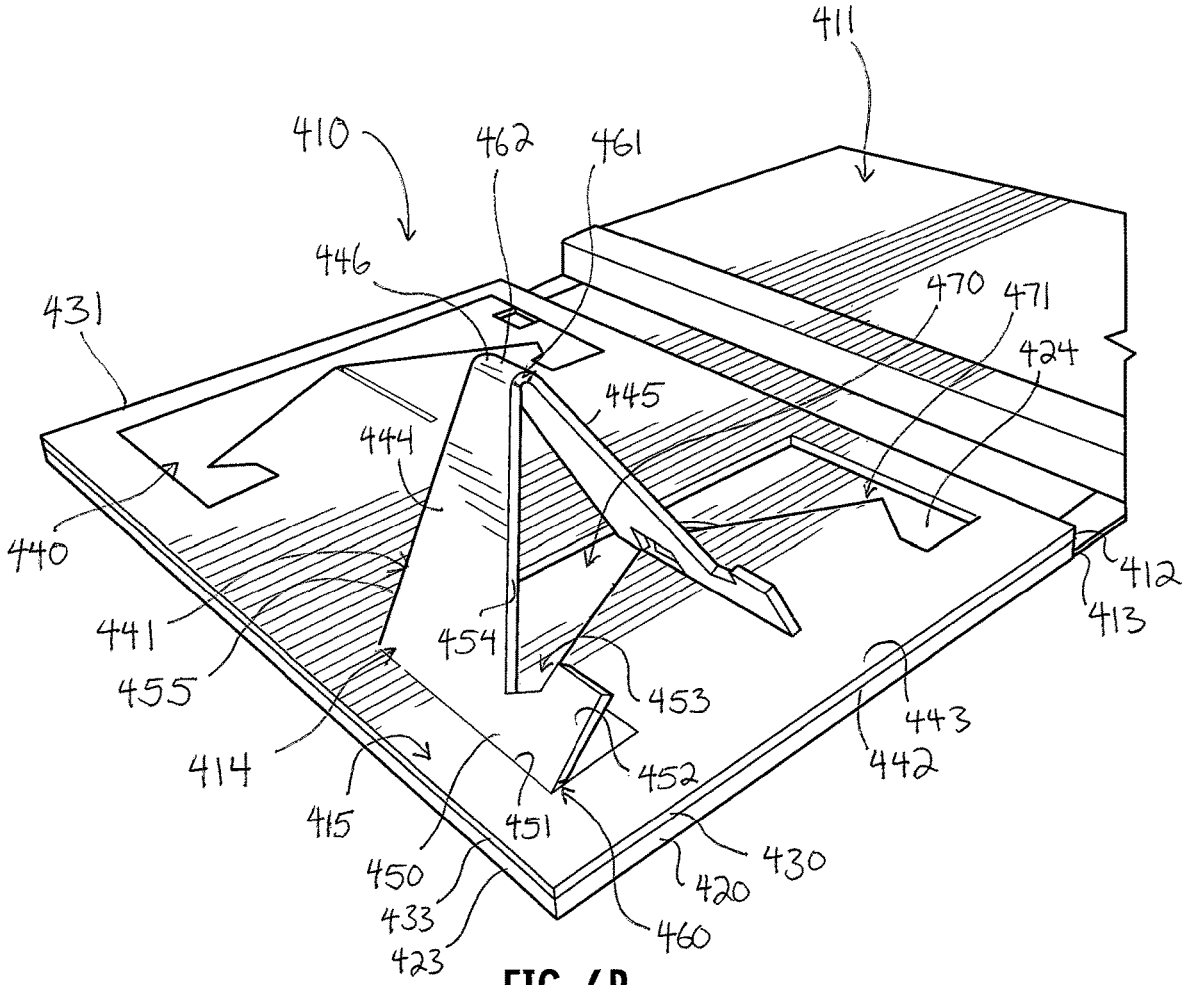
FIGS. 6B and 6C are top perspective views of the game board of FIG. 6A, with the foldable shape being raised to a raised position.
Figure 6C:
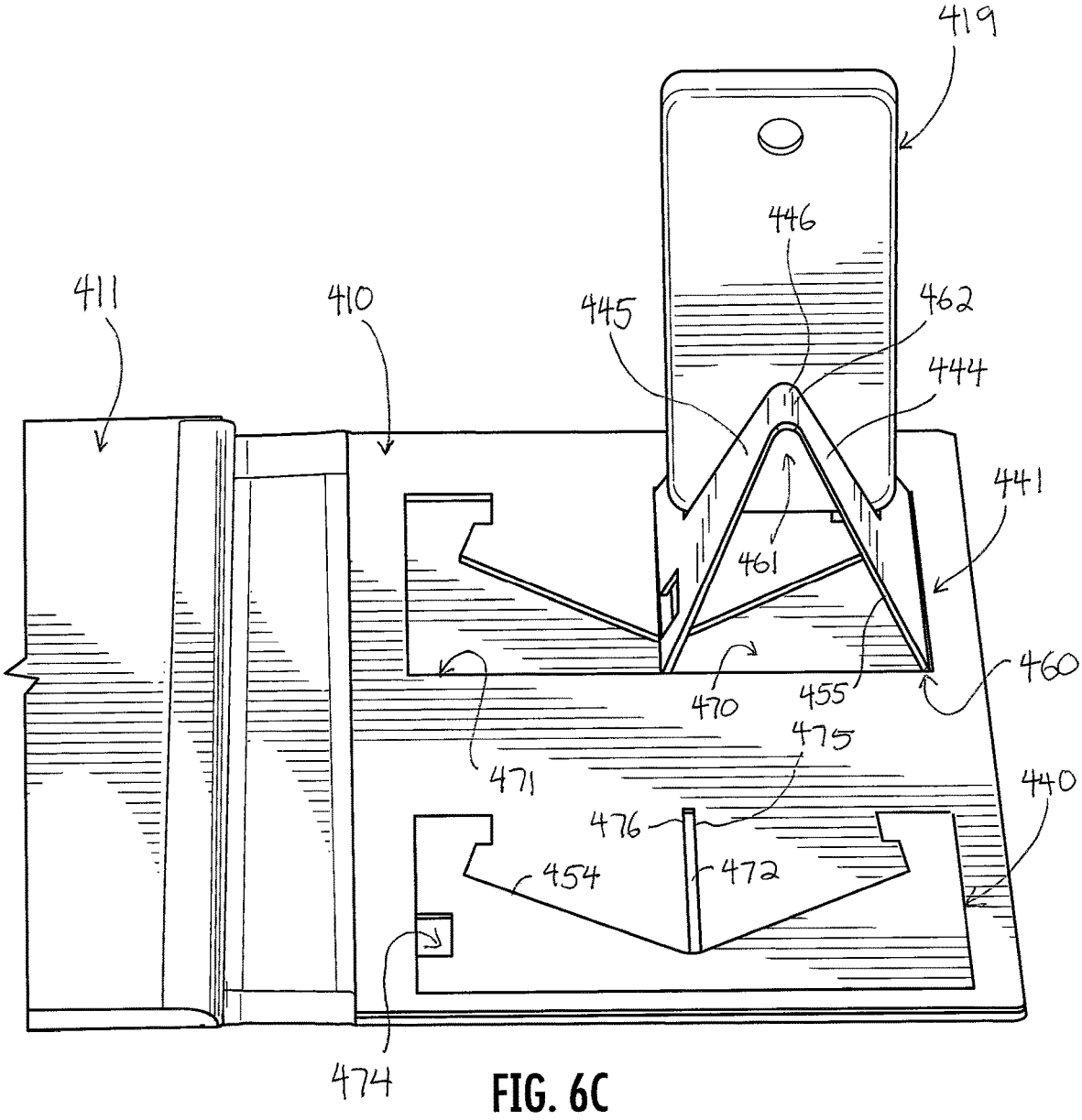

FIGS. 6A-6C illustrate an embodiment of a "game" board 410 for cradling a mobile phone 419 when the user wants to watch a movie or play a game on it. The board 410 is incorporated into a notebook 411 so that the board 410 is available to the user at any time the user becomes bored or desires a distraction; the owner can open the notebook 411, set up the board 410, and play a game or watch some content. By unfolding the board 410, the user can arrange a cradle that will securely and stably hold his phone 419. The board 410 is durable and constructed to sustain repeated folding and unfolding, so that it lasts for as long as the notebook 411 itself is useful.

The game board 410 includes a base sheet 412 and a top sheet 413 superposed on the base sheet 412 and fixed thereto. The top sheet 413 includes a foldable shape 414 that moves into and out of a flat shape 415, between a lowered position (as shown in FIG. 6A) and a raised position (as shown in FIGS. 6B and 6C) in which the foldable shape 414 forms a cradle, so that the phone 419 can be placed therein.

In the embodiment shown in FIGS. 6A-6C, the base sheet 412 is a rigid sheet of material forming the cover of the notebook 411. In some embodiments, the base sheet 412 is a separate piece of material, or is a separate piece of material bonded to otherwise fixed to the cover of a notebook 411, or may be a separate piece of material free of the notebook 411 cover entirely but available to be inserted into the notebook 411. In these drawings, however, the base sheet 412, and indeed, the board 410, is shown as part of the notebook 411. Indeed, the notebook 411 has a cover 417 constructed from fabric, woven cloth, leather, bicast leather, coated paper, or the like, which is glued to the board 410 to permanently secure it as part of the notebook 411.

In FIG. 6A, the base sheet 412 is hidden from view under the top sheet 413, but it can be seen in places where the foldable shape 414 has a through-hole. As such, names and reference characters for various structural elements and features of the base sheet 412 will be identified but may not be visible; nevertheless, one having ordinary skill in the art should be able to readily understand them, given they are basic parts. For instance, the base sheet 412 has a front 420, a back 421, and opposed sides 422 and 423. The base sheet 412 has a top, directed upwardly away from the page, and an opposed bottom, directed downwardly into the page. The base sheet 412 is rectangular but need not be so limited; in notebooks 411 of different sizes and shapes, the base sheet 412 has different proportions than those shown in the drawings, and where the board 410 is separate from the notebook 411, the base sheet 412 has any suitable size and shape. The base sheet 412, however, is preferably rigid, strong, and durable, constructed from a material or combination of materials such as thick cardstock, plastic, or even metal. The base sheet 412 additionally has a top surface 424 which is exposed in areas in which the foldable shape 414 is lifted up. The top surface 424 is flat, smooth, and continuous between the front 420, back 421, and sides 422 and 423.

The top sheet 413 is carried against this top surface 424. The top sheet 413 is also constructed from a material or combination of materials such as thick cardstock, plastic, or even metal, having rigid, strong, and durable material characteristics. However, the top sheet 413 is cut so that portions of it can be separated from, lifted off of, and arranged with respect to the base sheet 412. In this way, the top sheet 413 forms the cradle to hold the phone 419.

Referring still to FIGS. 6A-6C, the top sheet 413 has a front 430, a back 431, opposed sides 432 and 433, a bottom directed toward the top surface 424 of the base sheet 412, and an opposed top 434. The front 430 and back 431 are preferably parallel to each other, and each perpendicular to each of the sides 432 and 433, which in turn are preferably parallel to each other. The top sheet 413 is thin between the bottom and top 434, having a thickness of approximately a few millimeters.

Two offset, identical profiles 435 are cut into the top sheet 413; only one will be described because they are identical, and the reader will understand that the description applies to both equally. The profile 435 is a cut passing entirely through the top sheet 413 from the top 434 to the bottom. It is continuous around the top sheet 413 so as to define a contour or shape in the top sheet 413. The profile 435 delineates and severs the foldable shape 414 from the flat shape 415. While the foldable shape 414 is lifted and arranged to define the upstanding cradle, the flat shape 415 remains flat, in contact with the base sheet 412. The profile 435 is the boundary therebetween, allowing the foldable shape 414 to be entirely separated from and thus lifted above the flat shape 415. Removal of the foldable shape 414, however, is limited by flexible sheets 442 and 443 which are adhered to the top 434 and bottom of the top sheet 413, over both the foldable shape 414 and the flat shape 415. The profile 435 cuts through the flexible sheets 442 and 443 in a corresponding contour to that through the top sheet 413. The flexible sheets 442 and 443 are preferably a fabric, woven cloth, or the like, allowing the foldable shape 414 to move and flex with respect to the flat shape 415; the flexible sheets 442 and 443 are discussed in more detail later.

The foldable shape 414 includes two cradles 440 and 441. The cradles 440 and 441 are identical, and the same reference characters are used to describe the same structural elements and features of each. Further, reference will be made to both or either of the cradles 440 and 441 without distinction, and one having ordinary skill in the art should understand that, unless otherwise indicated, any discussion of one of the cradles 440 and 441 applies equally to the other. The cradle 441 includes opposed legs 444 and 445 coupled at a hip 446. The legs 444 are identical and opposite, and discussion will be made with respect to only one, but the same reference characters will be used for both. The leg 444 includes a long base 450, extending parallel to the side 433. The base 450 of the leg 444 is pivoted to the top sheet 413 with a living hinge 451, while the base 450 of the leg 445 is free and slides along the top surface 424 of the base sheet 412 as that cradle 441 moves between the lowered and raised positions.

The leg 444 has a foot 452 which extends forwardly toward the front 430 of the top sheet 413. The foot 452 is formed with an inward notch 453 which is directed upward when the cradle 440 is moved into the raised position. From the notch 453, a front edge 454 extends obliquely to the hip 446, which is poised above both legs 444 and 445. The cradle 441 has a back edge 455 which is opposite to the front edge 454, and which extends entirely over to and is common to the leg 445. The back edge 455 is normal to the side 433.

The cradle 441 is separated from the top sheet 413, but flexible with respect to it, because it is joined to the top sheet 413 by the flexible sheets 442 and 443. A slender gap or slit 460 spaces the base 450 of the leg 444 apart from the top sheet 413. The slit 460 extends entirely across the leg 44, parallel to the side 433. The slit 460 has a width which is approximately equal to the thickness of the top sheet 413. A second slender gap or slit 4461 is disposed at the hip 446, entirely separating the legs 444 and 445 from each other. This slit 461 also has a width which is approximately equal to the thickness of the top sheet 413. These slits 460 and 461 enable flexible movement of the cradle 441. The flexible sheets 442 and 443 are thin, resilient layers constructed from woven fabric, woven cloth, leather, bicast leather, coated paper, or the like, which are applied over the top sheet 413. The flexible sheet 442 is applied continuously across the top 434 of the top sheet 413, over both the foldable shape 414 and the flat shape 415. Similarly, the flexible sheet 443 is applied continuously under the base sheet 412, under the both the foldable shape 414 and the flat shape 415.

As mentioned above, the profile 435 cuts entirely through the top sheet 413 and the flexible sheets 442 and 443 along the foldable shape 414, but it does not cut through the sheets 442 and 443 at the slits 460 and 461. As such, the flexible sheets 442 and 443 form living hinges 451 and 462 at the slits 460 and 461, respectively. The hinge 451 flexes to allow the cradle 444 to be raised up away from the base sheet 412, and the hinge 462 flexes to allow the legs 444 and 445 to be bent with respect to each other.

As described above, the profile 435 delineates the foldable shape 414 from the flat shape 415. The flat shape 415 surrounds the foldable shape 414 and so has a shape which is approximately the negative of the flat shape 415. The flat shape 415 is the remainder of the top sheet 413 when the foldable shape 414 is lifted up. With the base sheet 412 below it, the flat shape 415 defines roughly two triangular-shaped channels 470 and 4472 in the board 410 from which the foldable shape 414 is removed.

These channels generally correspond to the foldable shape 414. Both of these channels 470 and 4472 are just slightly wider than its corresponding piece of the cradle 441; a close fit between the foldable shape 414 and the channels 470 and 4472 in the flat shape 415 ensures that the foldable shape 414 snaps into the channels and is retained in the lowered position, while a loose fit between the foldable shape 414 and the channels 470 and 4472 in the flat shape 415 would allow the foldable shape 414 to inadvertently come loose from the top sheet 413, possibly incurring damage.

A notch or recess 474 is formed in the base 450 of the leg 445. This allows the user to grasp the leg 445 and pry it upward to initiate movement of the foldable shape 414 from the lowered position to the raised position. In the lowered position of the foldable shape 414, as shown in FIG. 6A, the foldable shape 414 is entirely flat, in continuous and direct contact against the base sheet 412, and its top 434 is contiguous with the top 434 of the top sheet 413, such that, preferably, no part of the foldable shape 414 projects above the top 434. In this way, the foldable shape 414 lies flat and compact, and the notebook 411 can be closed and carried with the user.

To move the foldable shape 414 to the raised position, the user places his fingers into the recess 474 and lifts, pulling the leg 445 upward and over toward the side 433. By doing this, the two bases 450 of the legs 444 and 445 move toward each other. Preferably, as the foldable shape 414 rises, the base 450 of the leg 445 simply slides along the top 434 of the top sheet 413. As the leg 445 slides over, the cradle 441 begins to rise. Both of the living hinges 451 and 462 flex to accommodate this movement.

The base 450 of the leg 445 continues to slide over until it drops into a cross channel 472, as shown in FIGS. 6B and 6C. The cross channel 472 is recessed below the top 434 of the top sheet 413. It is a narrow slit, parallel to the side 433, and defined between two edges 475 and 476, both of which are parallel to the side 433.

Both edges 475 and 476 define stops. The edges 475 and 476 project above the top surface 424 of the base sheet 412, generally normal to the top surface 424, to form inner corners. The inner corner formed by the edge 475 becomes a stop against movement of the leg 444 toward the side 433, and the inner corner formed by the edge 476 becomes a stop against movement of the leg 445 toward the side 434. As such, once the base 450 of the leg 445 slides into the cross channel 472, it is seated therein and will not inadvertently come out of the cross channel 472 because it encounters the stops and is prevented from further lateral movement. Therefore, once the foldable shape 414 is moved into its raised position, as shown in FIGS. 6B and 6C, the base 450 of the leg 445 rests in the cross channel 472, thereby buttressing the leg 445, which in turn holds the leg 444, which holds the cradle 441 upright, vertical, and facing toward the user.

The user can now place a mobile phone 419 in the cradle 441. As shown in FIG. 6C, the user places the phone 419 into the two notches 453 of the legs 444 and 445, resting the phone 419 against the front edges 454. The phone 419 is shown in FIG. 6C in a vertical orientation, but it can of course be placed in a horizontal orientation.

When the user is done watching or playing with the phone 419, the foldable shape 414 is returned to its lowered position. The user picks the foldable shape 414 up, preferably by grasping the free leg 445 between his fingers and lifting up from the top sheet 413, thereby freeing leg 445 from the cross channel 472. Once the leg 445 is removed from the cross channel 472, it can be moved toward the side 432, which causes the cradle 441 to lie down as well. The foldable shape 414 is thus returned to and maintained in its lowered position, and the notebook 411 can be closed and carried with the user, for later use. Indeed, all embodiments presented herein may use similar engagement elements to retain the board 410 in the lowered position, even if not explicitly so stated.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A device comprising:

a base sheet having a front, an opposed back, and a planar top surface extending between the front and back of the base sheet;

a top sheet disposed on the top surface of the base sheet, the top sheet having a front registered with the front of the base sheet, and the top sheet having a back registered with the back of the base sheet, such that the top sheet is registered with the base sheet;

both a foldable shape and a flat shape in the top sheet, wherein the foldable shape and the flat shape are delineated by a profile cut through the top sheet, the flat shape is fixed to the top surface of the base sheet, and the foldable shape is hinged to the flat shape proximate the front of the top sheet, such that the foldable shape is moveable between a lowered position and a raised position while the flat shape remains disposed on the top surface of the base sheet;

the flat shape has a forwardly-directed edge formed by the profile, which forwardly-directed edge is disposed between the front and back of the top sheet, is directed toward the front of the top sheet, and projects above the top surface of the base sheet so as to define a stop formed by the base and top sheets; and the foldable shape has a rearwardly-directed edge which, when the foldable shape is in the lowered position, is disposed proximate the back of the top sheet and which, when the foldable shape is in the raised position, rests against the stop so as to prevent the foldable shape from moving into the lowered position.

2. The device of claim 1, wherein the foldable shape includes a forward goal and a rearward support.

3. The device of claim 2, wherein the forward goal is separated from the flat shape by a first slit, and the rearward support is separated from the forward goal by a second slit.

4. The device of claim 2, wherein the foldable shape moves between the lowered and raised positions along a single line of movement.

5. The device of claim 4, wherein the rearward support includes a leading edge which is oblique to the line of movement.

6. The device of claim 1, further comprising:

a flexible sheet superposing the top sheet;

the profile entirely separates the foldable shape from the flat shape; and the flexible sheet forms a living hinge between the foldable shape and the flat shape.

7. The device of claim 6, wherein the foldable shape has a front and a back, and the front and back move toward each other when the top sheet moves from the lowered position.

8. The device of claim 1, wherein the foldable shape includes an engagement element and the flat shape includes a complemental engagement which is engaged to the engagement element when the top sheet is in the lowered position.

9. A device comprising:

a base sheet having a front, an opposed back, and a planar top surface extending between the front and back of the base sheet;

a top sheet fixed to the base sheet, the top sheet having a front registered with the front of the base sheet, and the top sheet having a back registered with the back of the base sheet, such that the top sheet is registered with the base sheet;

both a foldable shape and a flat shape in the top sheet, wherein the foldable shape and the flat shape are delineated by a profile cut through the top sheet, the flat shape is fixed to the top surface of the base sheet, and the foldable shape is hinged to the flat shape proximate the front of the top sheet, such that the foldable shape is moveable between a lowered position and a raised position while the flat shape remains disposed on the top surface of the base sheet;

the foldable shape includes a forward goal and a rearward support;

the flat shape has a forwardly-directed edge formed by the profile, which forwardly-directed edge is disposed between the front and back of the top sheet, is directed toward the front of the top sheet and projects above the top surface of the base sheet define a stop formed by both the base and top sheets; and the foldable shape has a rearwardly-directed edge on its rearward support which, when the foldable shape is in the lowered position, is disposed proximate the back of the top sheet and which, when the foldable shape is in the raised position, rests against the stop so as to hold the forward goal up and prevent the foldable shape from moving into the lowered position.

10. The device of claim 9, wherein the forward goal is separated from the flat shape by a first slit, and the rearward support is separated from the flat shape by a second slit.

11. The device of claim 9, wherein the foldable shape moves between the lowered and raised positions along a single line of movement.

12. The device of claim 11, wherein the rearward support includes a leading edge which is oblique to the line of movement.

13. The device of claim 9, further comprising:

a flexible sheet superposing the top sheet;

the profile entirely separates the foldable shape from the flat shape; and the flexible sheet forms a living hinge between the foldable shape and the flat shape.

14. The device of claim 13, wherein the foldable shape has a front and a back, and the front and back move toward each other when the top sheet moves from the lowered position.

15. The device of claim 9, wherein the foldable shape includes an engagement element and the flat shape includes a complemental engagement which is engaged to the engagement element when the top sheet is in the lowered position.

16. A device comprising:

a base sheet having a front, an opposed back, and a planar top surface extending between the front and back of the base sheet;

a top sheet superposed on the top surface of the base sheet and fixed to the base sheet, the top sheet having a front registered with the front of the base sheet, and the top sheet having a back registered with the back of the base sheet, such that the top sheet is registered with the base sheet;

both a foldable shape and a flat shape in the top sheet, wherein the foldable shape and the flat shape are delineated by a profile cut through the top sheet, the flat shape is fixed to the top surface of the base sheet, and the foldable shape is hinged to the flat shape proximate the front of the top sheet, such that the foldable shape is moveable toward the front of the top sheet from a lowered position to a raised position along a single line of movement while the flat shape remains disposed on the top surface of the base sheet;

the foldable shape includes a forward goal and a rearward support, which rearward support includes a leading edge that is oblique to the line of movement; and the flat shape has a forwardly-directed edge formed by the profile, which forwardly-directed edge is disposed between the front and back of the top sheet, is directed toward the front of the top, and projects and projects above the top surface of the base sheet so as to define a stop formed by the base and top sheets; and the foldable shape has a rearwardly-directed edge which, when the foldable shape is in the lowered position, is disposed proximate the back of the top sheet and which, when the foldable shape is in the raised position, rests against the stop so as to prevent the foldable shape from moving into the lowered position.

17. The device of claim 16, wherein the forward goal is separated from the flat shape by a first slit, and the rearward support is separated from the flat shape by a second slit.

18. The device of claim 16, further comprising:

a flexible sheet superposing the top sheet;

the profile entirely separates the foldable shape from the flat shape; and the flexible sheet forms a living hinge between the foldable shape and the flat shape.

19. The device of claim 16, wherein the foldable shape has a front and a back, and the front and back move toward each other when the top sheet moves from the lowered position.

20. The device of claim 16, wherein the foldable shape includes an engagement element and the flat shape includes a complemental engagement which is engaged to the engagement element when the top sheet is in the lowered position.

* * * * *